US009268260B2

(12) United States Patent
Eto

(10) Patent No.: US 9,268,260 B2
(45) **Date of Patent: *Feb. 23, 2016**

(54) DEVELOPER CONTAINER AND IMAGE FORMING APPARATUS INCLUDING THE SAME

(71) Applicant: KYOCERA Document Solutions Inc., Osaka-shi, Osaka (JP)

(72) Inventor: Daisuke Eto, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/666,752

(22) Filed: Mar. 24, 2015

(65) Prior Publication Data

US 2015/0277289 A1 Oct. 1, 2015

(30) Foreign Application Priority Data

Mar. 27, 2014 (JP) ..... 2014-065032

(51) Int. Cl.
*G03G 15/08* (2006.01)

(52) U.S. Cl.
CPC ..... *G03G 15/0889* (2013.01); *G03G 15/0865* (2013.01); *G03G 15/0893* (2013.01)

(58) Field of Classification Search
CPC ..... G03G 15/0865; G03G 15/0886; G03G 15/0836; G03G 15/0839; G03G 15/087; G03G 15/0877; G03G 15/0889
See application file for complete search history.

(56) References Cited

U.S. PATENT DOCUMENTS

| | | | | |
|---|---|---|---|---|
| 8,918,032 | B2 * | 12/2014 | Abler et al. | 399/262 |
| 8,923,734 | B2 * | 12/2014 | Abler et al. | 399/262 |
| 9,063,460 | B2 * | 6/2015 | Abler et al. | |
| 2008/0260431 | A1 * | 10/2008 | Saito | 399/256 |
| 2009/0269112 | A1 | 10/2009 | Fukunaga et al. | |
| 2011/0150537 | A1 * | 6/2011 | Watanabe et al. | 399/256 |
| 2015/0185659 | A1 * | 7/2015 | Konishi et al. | 399/262 |
| 2015/0185661 | A1 * | 7/2015 | Eto | 399/262 |
| 2015/0185663 | A1 * | 7/2015 | Nakamura et al. | 399/262 |

FOREIGN PATENT DOCUMENTS

| | | |
|---|---|---|
| JP | 2003-280344 | 10/2003 |
| JP | 2009-265395 | 11/2009 |

* cited by examiner

*Primary Examiner* — Rodney Bonnette
(74) *Attorney, Agent, or Firm* — Gerald E. Hespos; Michael J. Porco; Matthew T. Hespos

(57) ABSTRACT

A developer container includes a container body, a shaft, a movable wall, and a stirring member. The container body is formed with a developer discharge port. The developer discharge port lies at a position higher than a lowest part of the container body by a predetermined amount. The movable wall includes an outer surface slidably in close contact with an inner surface of the container body, and a conveying surface defining a storage space for the developer in cooperation with the inner surface of the container body. The movable wall moves along the shaft in the internal space while conveying the developer in the storage space to the developer discharge port. The stirring member is rotated around an axis of the shaft in a specified rotational direction to stir the developer, the specified rotational direction proceeding from the lowest part of the container body to the developer discharge port.

14 Claims, 17 Drawing Sheets

BACKWARD
LEFT
RIGHT
TOP
BOTTOM
FORWARD
30
31
311
312
313
314
315
316
318
31T
37
38
39
40
50
391
392
M

TOP
RIGHT
BACKWARD
FORWARD
LEFT
BOTTOM
34
34K
341
341A
340
342
344
340C
340D
34J

TOP
RIGHT
BACKWARD
FORWARD
LEFT
BOTTOM
34
34K
341
341A
342A
342B
340B
344
34J
342
343
340S
340A
340
344
340B

DEVELOPER CONTAINER AND IMAGE FORMING APPARATUS INCLUDING THE SAME

INCORPORATION BY REFERENCE

This application is based on Japanese Patent Application No. 2014-065032 filed with the Japan Patent Office on Mar. 27, 2014, the contents of which are hereby incorporated by reference.

BACKGROUND

The present disclosure relates to a developer container for containing developer and an image forming apparatus including the developer container.

Conventionally, the following toner container is known as an example of developer containers for containing developer. The toner container includes a toner discharge port and a rotary stirring member. Toner is discharged through the toner discharge port by rotation of the stirring member.

SUMMARY

A developer container according to an aspect of the present disclosure includes a container body, a second wall, a shaft, a movable wall, and a stirring member. The container body includes an inner surface defining a cylindrical internal space extending in a first direction, and a first wall disposed at one end of the container body in the first direction and defining one end surface of the internal space. The container body is formed with a developer discharge port opening in a circumferential portion of the container body, the developer discharge port being disposed at a position higher than a lowest part of the container body by a predetermined amount and communicating with the internal space for allowing discharge of developer therethrough. The second wall is disposed at the other end of the container body that is opposite to the first wall in the first direction and defining the other end surface of the internal space. The shaft is disposed in the internal space and above the discharge port, and extends in the first direction, the shaft being supported on the first wall and the second wall. The movable wall includes an outer surface slidably in close contact with the inner surface of the container body, and a conveying surface defining a storage space for the developer in cooperation with the inner surface of the container body, the movable wall being movable along the shaft in the internal space while conveying the developer in the storage space to the developer discharge port. The stirring member faces the developer discharge port in a direction intersecting the first direction and is rotatable around an axis of the shaft in a specified rotational direction to stir the developer in the storage space, the specified rotational direction proceeding from the lowest part of the container body to the developer discharge port.

An image forming apparatus according to another aspect of the present disclosure includes the above-described developer container, an image carrier, a developing device, and a transfer section. The image carrier has a surface for allowing an electrostatic latent image to be formed thereon and operable to carry a developed image. The developing device receives the developer supplied from the developer container and supplies the developer to the image carrier. The transfer section transfers the developed image from the image carrier onto a sheet.

These and other objects, features and advantages of the present disclosure will become more apparent upon reading the following detailed description along with the accompanying drawings.

DETAILED DESCRIPTION

Figure 1:
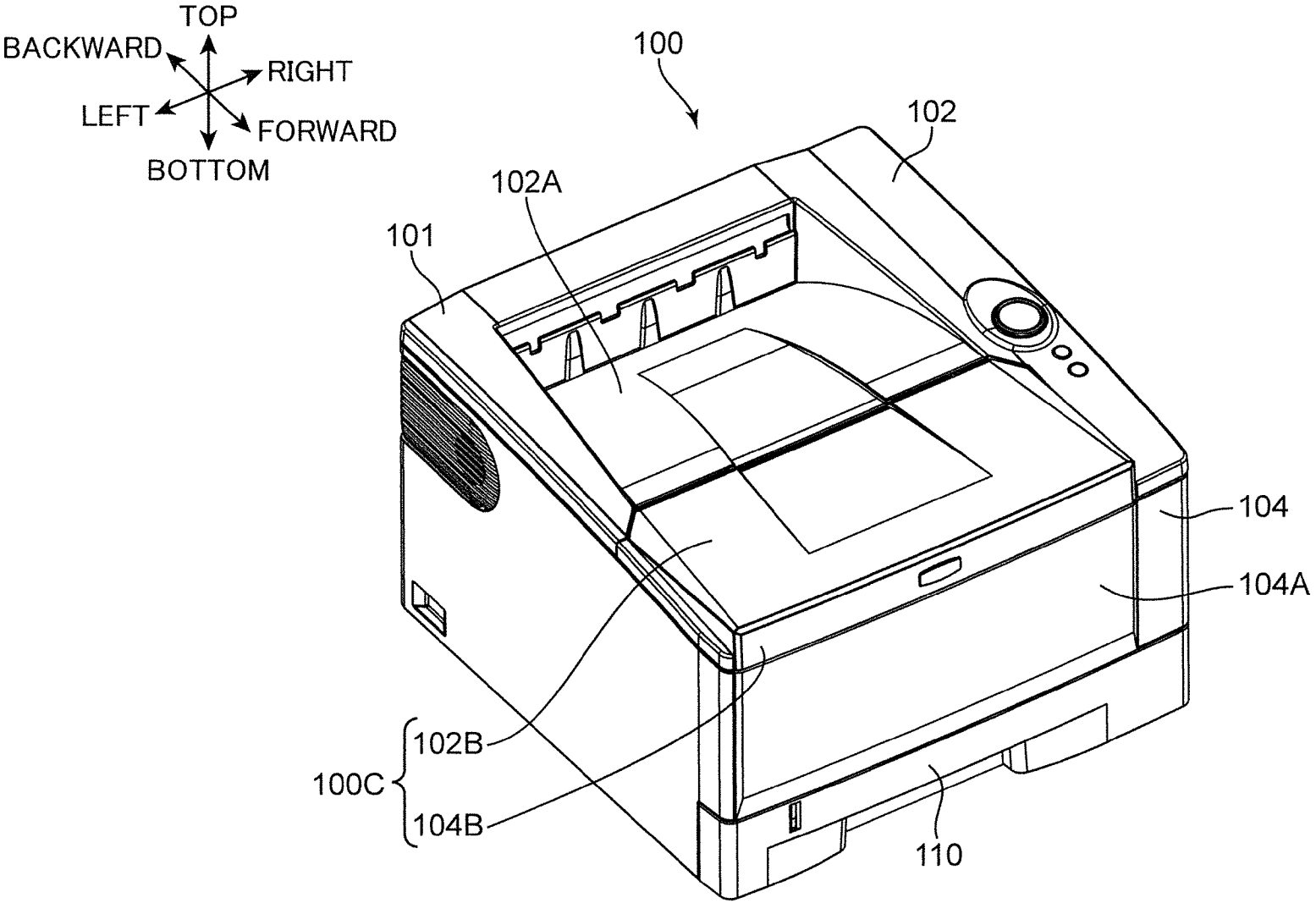
FIG. 1 is a perspective view of an image forming apparatus according to an embodiment of the present disclosure.
Figure 2:
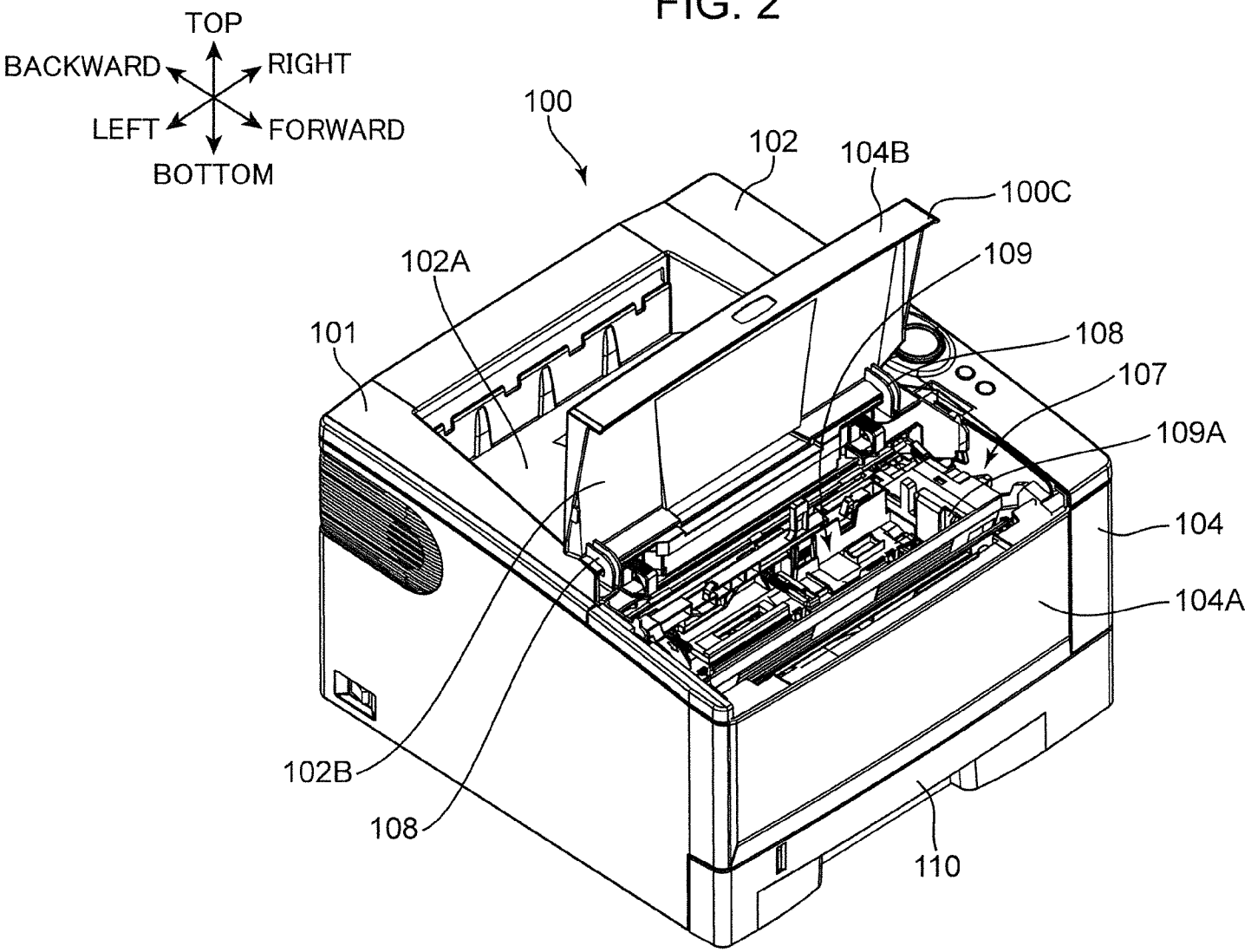
FIG. 2 is a perspective view of the image forming apparatus according to the embodiment of the present disclosure, a part of the apparatus being opened.
Figure 3:
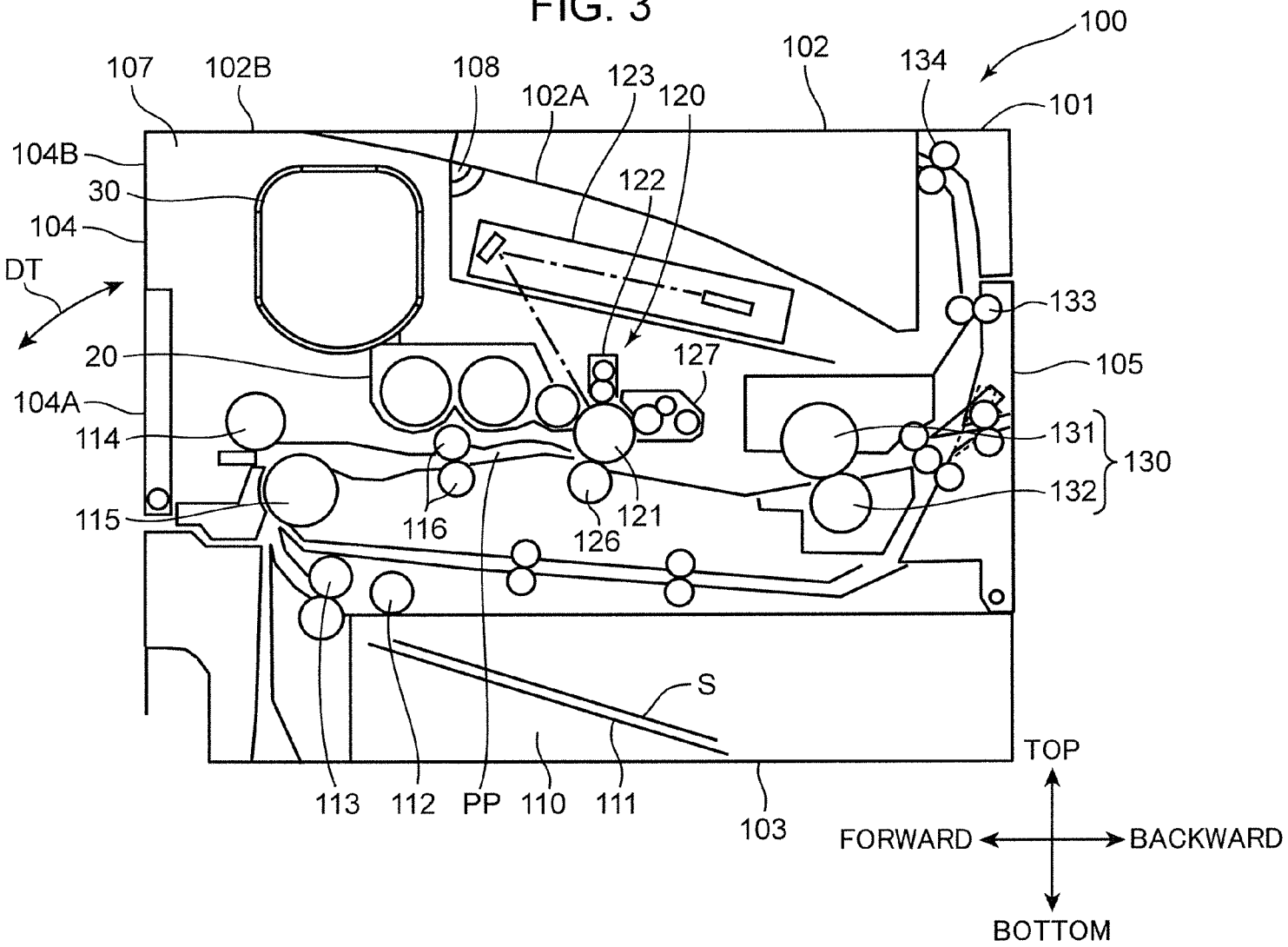
FIG. 3 is a schematic sectional view showing an internal structure of the image forming apparatus according to the embodiment of the present disclosure.

Hereinafter, an embodiment of the present disclosure will be described with reference to the accompanying drawings. FIG. 1 and FIG. 2 are perspective views of a printer 100 (image forming apparatus) according to an embodiment of the present disclosure. FIG. 3 is a schematic sectional view showing an internal structure of the printer 100 shown in FIGS. 1 and 2. The printer 100 shown in FIGS. 1 to 3, which exemplifies the image forming apparatus, is a so-called monochrome printer. However, other apparatuses may alternatively be provided as an image forming apparatus in other embodiments, such as a color printer, a facsimile apparatus or a multifunctional apparatus equipped with these functions, or another type of apparatus for forming a toner image on a sheet. It should be noted that hereinafter, terms indicating directions such as "top" "bottom" "forward" "backward" "left" and "right" are intended merely for descriptive purposes, and not for limiting the principle of the image forming apparatus.

The printer 100 includes a housing 101 for housing various components that are used for forming an image on a sheet S. The housing 101 includes a top wall 102 defining the top surface of the housing 101, a bottom wall 103 (FIG. 3) defining the bottom surface of the housing 101, a main body rear wall 105 (FIG. 3) connecting the top wall 102 and the bottom wall 103, and a main body front wall 104 located in front of the main body rear wall 105. The housing 101 includes a main body internal space 107 where various components are placed. A sheet conveyance passage PP extends in the main body internal space 107 of the housing 101, the sheet conveyance passage PP for allowing passage of a sheet S in a given conveying direction. Further, the printer 100 includes an opening/closing cover 100C mounted on the housing 101 in an openable and closable manner.

The opening/closing cover 100C includes a front wall upper portion 104B constituting an upper portion of the main body front wall 104, and a top wall front portion 102B constituting a front portion of the top wall 102. The opening/closing cover 100C can be vertically opened and closed with unillustrated hinge shafts acting as a fulcrum, the hinge shafts being respectively disposed on a pair of arms 108 disposed at lateral opposite ends of the opening/closing cover 100C (FIG. 2). When the opening/closing cover 100C is open, the main body internal space 107 is exposed to the outside at the top thereof. On the other hand, when the opening/closing cover 100C is closed, the main body internal space 107 is closed at the top thereof.

A sheet discharge section 102A is disposed in a central part of the top wall 102. The sheet discharge section 102A includes an oblique surface sloping downward from a front end to a rear end of the top wall 102. A sheet S that has been subjected to image formation in an image forming section 120 described later is discharged onto the sheet discharge section 102A. Further, a manual feed tray 104A is disposed in a vertically central part of the main body front wall 104. The manual feed tray 104A is vertically pivotable with a lower end thereof acting as a fulcrum (in the direction of an arrow DT shown in FIG. 3).

With reference to FIG. 3, the printer 100 includes a cassette 110, a pickup roller 112, a first sheet feeding roller 113, a second sheet feeding roller 114, a conveying roller 115, a pair of registration rollers 116, the image forming section 120, and a fixing device 130.

The cassette 110 stores sheets S therein. The cassette 110 includes a lift plate 111. The lift plate 111 is tilted to lift a leading edge of a sheet S. The cassette 110 can be pulled out forwardly with respect to the housing 101.

The pickup roller 112 is disposed above a leading edge of a sheet S lifted by the lift plate 111. The pickup roller 112 rotates to draw the sheet S from the cassette 110.

The first sheet feeding roller 113 is disposed downstream of the pickup roller 112 and conveys a sheet S further downstream. The second sheet feeding roller 114 is disposed at the inner side (rear side) of the fulcrum of the manual feed tray 104A and draws a sheet placed on the manual feed tray 104A into the housing 101.

The conveying roller 115 is disposed downstream of the first sheet feeding roller 113 and the second sheet feeding roller 114 in their sheet conveying direction (hereinafter, the sheet conveying direction also being referred to simply as "conveying direction", and the downstream in the sheet conveying direction also being referred to simply as "downstream"). The conveying roller 115 conveys a sheet fed by the first sheet feeding roller 113 or the second sheet feeding roller 114 further downstream.

The pair of registration rollers 116 functions to correct the angle of a sheet S that has been obliquely conveyed. This makes it possible to adjust the position of an image to be formed on the sheet S. The pair of registration rollers 116 supplies the sheet S to the image forming section 120 in accordance with timing of image formation to be performed by the image forming section 120.

The image forming section 120 includes a photoconductive drum 121 (image carrier), a charger 122, an exposure device 123, a developing device 20, a toner container 30 (developer container), a transferring roller 126 (transferring section), and a cleaning device 127.

The photoconductive drum 121 is in the form of a cylinder. The photoconductive drum 121 has a surface to be formed with an electrostatic latent image, and carries a toner image (developed image) corresponding to the electrostatic latent image on the surface. The charger 122 is applied with a predetermined voltage, and charges the circumferential surface of the photoconductive drum 121 substantially uniformly.

The exposure device 123 irradiates the circumferential surface of the photoconductive drum 121 charged by the charger 122 with beams of laser light. The beams of laser light are emitted in accordance with image data output from an external device such as personal computer (not shown) which is communicably connected to the printer 100. Consequently, the circumferential surface of the photoconductive drum 121 is formed with an electrostatic latent image corresponding to the image data.

The developing device 20 supplies toner to the circumferential surface of the photoconductive drum 121, the circumferential surface being formed with an electrostatic latent image. The toner container 30 supplies toner to the developing device 20. The toner container 30 is detachably attached to the developing device 20. When the developing device 20 has supplied toner to the photoconductive drum 121, the electrostatic latent image formed on the circumferential surface of the photoconductive drum 121 is developed (visualized). Consequently, the circumferential surface of the photoconductive drum 121 is formed with a toner image (developed image).

The transferring roller 126 is disposed below and opposite to the photoconductive drum 121 across the sheet conveyance passage PP. The transferring roller 126 defines a transfer nip in cooperation with the photoconductive drum 121 for transferring a toner image onto a sheet S.

The cleaning device 127 removes, after a toner image is transferred onto a sheet S from the circumferential surface of the photoconductive drum 121, toner remaining on the circumferential surface.

The fixing device 130 is disposed downstream of the image forming section 120 in the conveying direction, and fixes a toner image on a sheet S. The fixing device 130 includes a heating roller 131 for melting toner on a sheet S, and a pressure roller 132 for bringing the sheet S into close contact with the heating roller 131.

The printer 100 further includes a pair of conveying rollers 133 disposed downstream of the fixing device 130, and a pair of discharge rollers 134 disposed downstream of the pair of conveying rollers 133. A sheet S is conveyed upward by the pair of conveying rollers 133 to be finally discharged from the housing 101 by the pair of discharge rollers 134. The sheet S discharged from the housing 101 is placed on the sheet discharge section 102A, thereby resulting in a stack of sheets.

<Developing Device>

Figure 4:
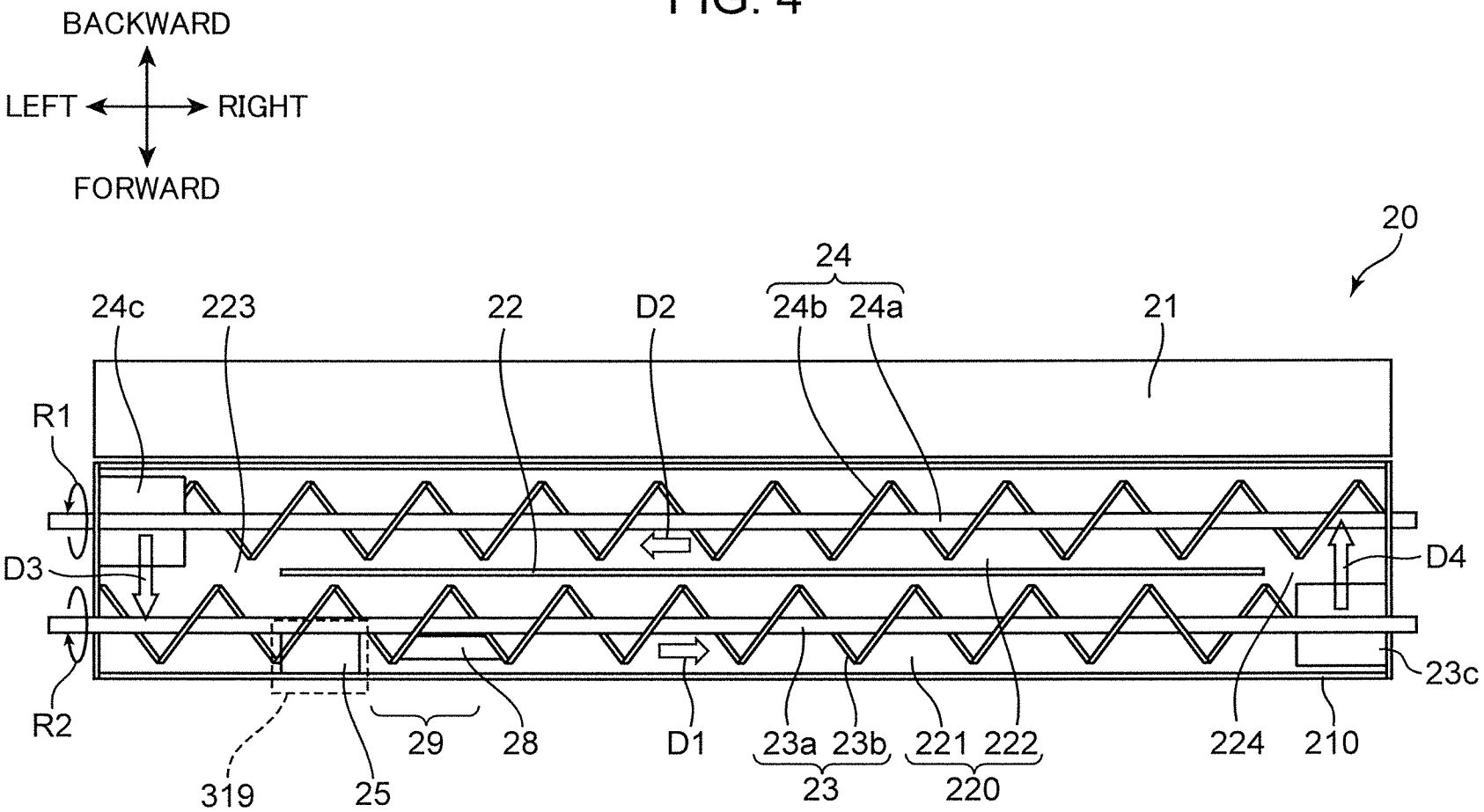
FIG. 4 is a schematic plan view showing an internal structure of a developing device according to the embodiment of the present disclosure.

FIG. 4 is a plan view showing an internal structure of the developing device 20. The developing device 20 includes a development housing 210 in the form of a box having a longer dimension in a specific direction (an axial direction of a developing roller 21 or a left-right direction). The development housing 210 includes a storage space 220. In the storage space 220, there are disposed the developing roller 21, a first stirring screw 23, a second stirring screw 24, and a toner supply port 25. The present embodiment employs a one-component developing method and, therefore, the storage space 220 is filled with toner that is to be used as developer. On the other hand, in the case of a two-component developing method, a mixture of toner and carrier consisting of a magnetic material is filled as developer. The toner is circulatively conveyed in the storage space 220 and successively supplied from the developing roller 21 to the photoconductive drum 121 in order to develop an electrostatic latent image.

The developing roller 21 is in the form of a cylinder extending in the longitudinal direction of the development housing 210, and includes a sleeve constituting a circumferential portion of the developing roller 21 and operable to be rotationally driven.

The storage space 220 of the development housing 210 is covered by an unillustrated top portion and divided, by a partition plate 22 extending in the left-right direction, into a first conveyance passage 221 and a second conveyance passage 222 having a longer dimension in the left-right direction. The partition plate 22 is shorter than the lateral width of the development housing 210 to define a first communication passage 223 and a second communication passage 224 respectively at the left and right sides of the partition plate 22, the first and second communication passages 223 and 224 allowing communication between the first conveyance passage 221 and the second conveyance passage 222. Consequently, there is a circulation passage constituted by the first conveyance passage 221, the second communication passage 224, the second conveyance passage 222, and the first communication passage 223 in the storage space 220. Toner is conveyed through the circulation passage counterclockwise in FIG. 4.

The toner supply port 25 (developer receiving port) is an opening formed in the top portion, and is disposed above and near a left end of the first conveyance passage 221. The toner supply port 25 faces the above-mentioned circulation passage, and functions to allow replenishment toner (replenishment developer) supplied from the toner container 30 to flow into the storage space 220.

The first stirring screw 23 is disposed in the first conveyance passage 221. The first stirring screw 23 includes a first rotary shaft 23*a*, and a first spiral blade 23*b* (screw blade) in the form of a spiral protrusion formed on the circumferential surface of the first rotary shaft 23*a*. The first stirring screw 23 is driven to rotate around the axis of the first rotary shaft 23*a* (in the direction of an arrow R2) to convey toner in the direction of an arrow D1 shown in FIG. 4. The first stirring screw 23 conveys toner so that the toner passes through a portion of the first conveyance passage 221 that faces the toner supply port 25. Therefore, the first stirring screw 23 functions to convey and mix toner having been conveyed from the second conveyance passage 222 with new toner flowing in from the toner supply port 25 in the first conveyance passage 221. A first paddle 23*c* is disposed in a downstream part of the first stirring screw 23 in the toner conveying direction (in the arrow D1 direction). The first paddle 23*c* is in the form of a plate-shaped member disposed on the first rotary shaft 23*a*. The first paddle 23*c* is rotated with the first rotary shaft 23*a* to deliver toner from the first conveyance passage 221 to the second conveyance passage 222 in the direction of an arrow D4 shown in FIG. 4.

The second stirring screw 24 is disposed in the second conveyance passage 222. The second stirring screw 24 includes a second rotary shaft 24*a*, and a second spiral blade 24*b* in the form of a spiral protrusion formed on the circumferential surface of the second rotary shaft 24*a*. The second stirring screw 24 is driven to rotate around the axis of the second rotary shaft 24*a* (in the direction of an arrow R1) to supply toner to the developing roller 21 while conveying toner in the direction of an arrow D2 shown in FIG. 4. A second paddle 24*c* is disposed in a downstream part of the second stirring screw 24 in the toner conveying direction (in the arrow D2 direction). The second paddle 24 is rotated with the second rotary shaft 24*a* to deliver toner from the second conveyance passage 222 to the first conveyance passage 221 in the direction of an arrow D3 shown in FIG. 4.

The toner container 30 (FIG. 3) is disposed above the toner supply port 25 of the development housing 210. The toner container 30 includes a toner discharge port 319 (FIG. 4). The toner discharge port 319 is disposed at a bottom portion 311 (FIG. 7) of the toner container 30 and corresponds to the toner supply port 25 of the development housing 20. Toner falling through the toner discharge port 319 passes through the toner supply port 25 to be supplied to the development device 20.

<Supply of Toner>

Figure 5:
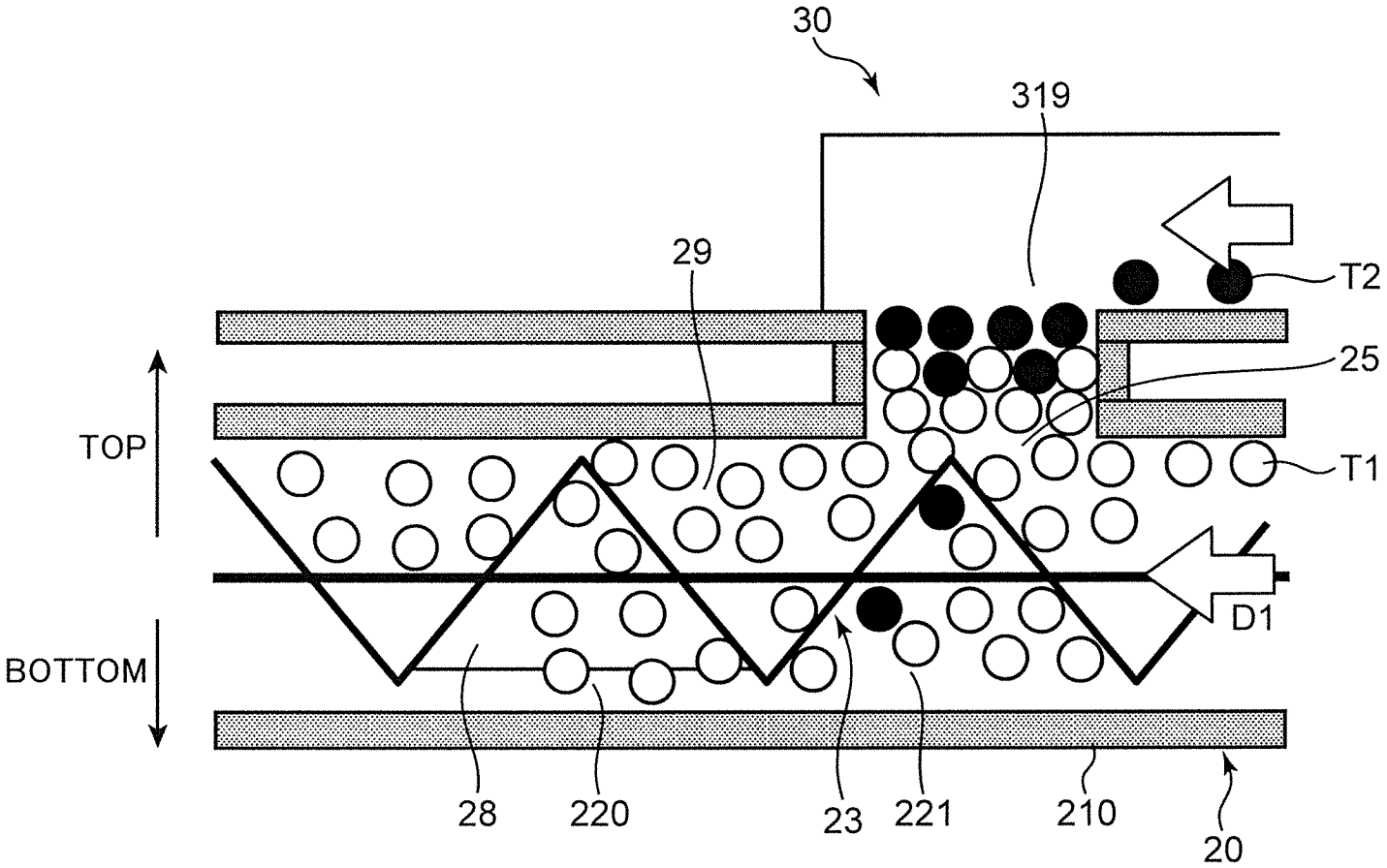
FIG. 5 is schematic sectional view illustrating supply of developer to the developing device according to the embodiment of the present disclosure.

Now, there will be described a flow of toner that is newly supplied through the toner supply port 25. FIG. 5 is a sectional view of the vicinity of the toner supply port 25 disposed in the developing device 20 and the toner discharge port 319 disposed in the toner container 30.

Replenishment toner T2 that is supplied through the toner discharge port 319 of the toner container 30 falls into the first conveyance passage 221 to be mixed with existing toner T1, and the mixture of toners T1 and T2 are conveyed in the arrow D1 direction by the first stirring screw 23. At this time, the toners T1 and T2 are stirred and charged.

The first stirring screw 23 includes a reducing paddle 28 (conveying ability reducing portion) disposed downstream of the toner supply port 25 in the toner conveying direction, the reducing paddle for partially reducing the ability of conveying toner. In the present embodiment, the reducing paddle 28 is in the form of a plate-like member extending between a particular advancing point and a particular receding point of a turn of the first spiral blade 23*b* of the first stirring screw 23. The reducing paddle 28 rotates with the first rotary shaft 23*a* to cause toner being conveyed from the upstream side of the reducing paddle 28 to begin to accumulate. The accumulation of toner grows up to immediately upstream of the reducing paddle 28, that is, a portion where the toner supply port 25 faces the first conveyance passage 221. As a result, a tonner accumulation portion 29 (developer accumulation portion) appears near the inlet of the toner supply port 25.

When the amount of toner in the storage space 220 has increased due to the supply of replenishment toner T2 though the toner supply port 25, the toner of the accumulation portion 29 covers (seals) the toner supply port 25, which prevents further toner supply. Thereafter, as the toner of the accumulation portion 29 decreases in amount because of consumption of the toner in the storage space 220 by the developing roller 21, the amount of toner covering the toner supply port 25 decreases such that a gap appears between the accumulation portion 29 and the toner supply port 25. This allows new inflow of replenishment toner T2 into the storage space 220 through the toner supply port 25. In this manner, the present embodiment employs the volume replenishment type toner supply method in which the amount of replenishment toner to be received is adjusted in accordance with a decrease in the amount of toner of the accumulation portion 29.

<Structure of Toner Container>

Figure 6:
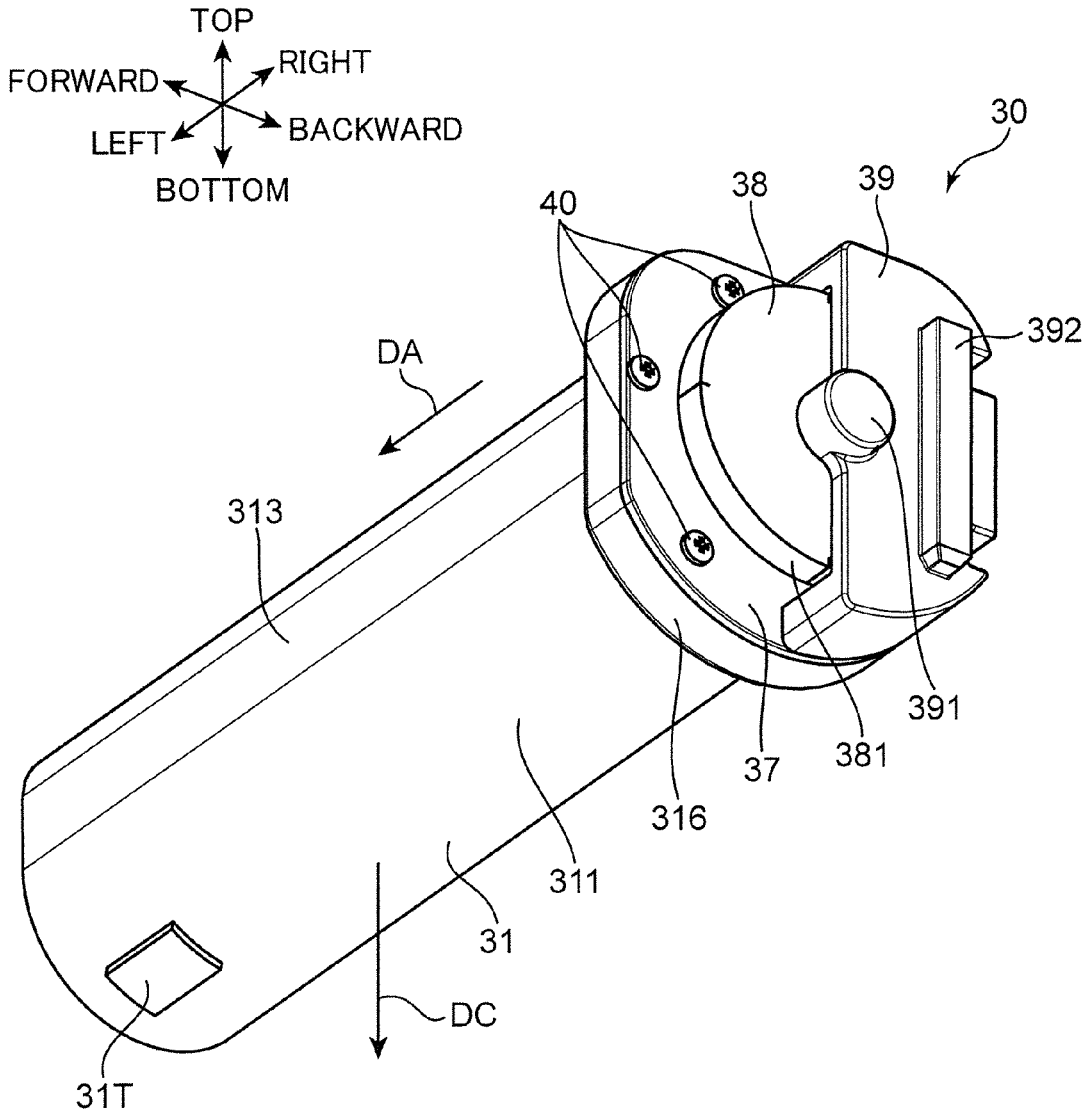
FIG. 6 is a perspective view of a developer container according to the embodiment of the present disclosure.
Figure 7:
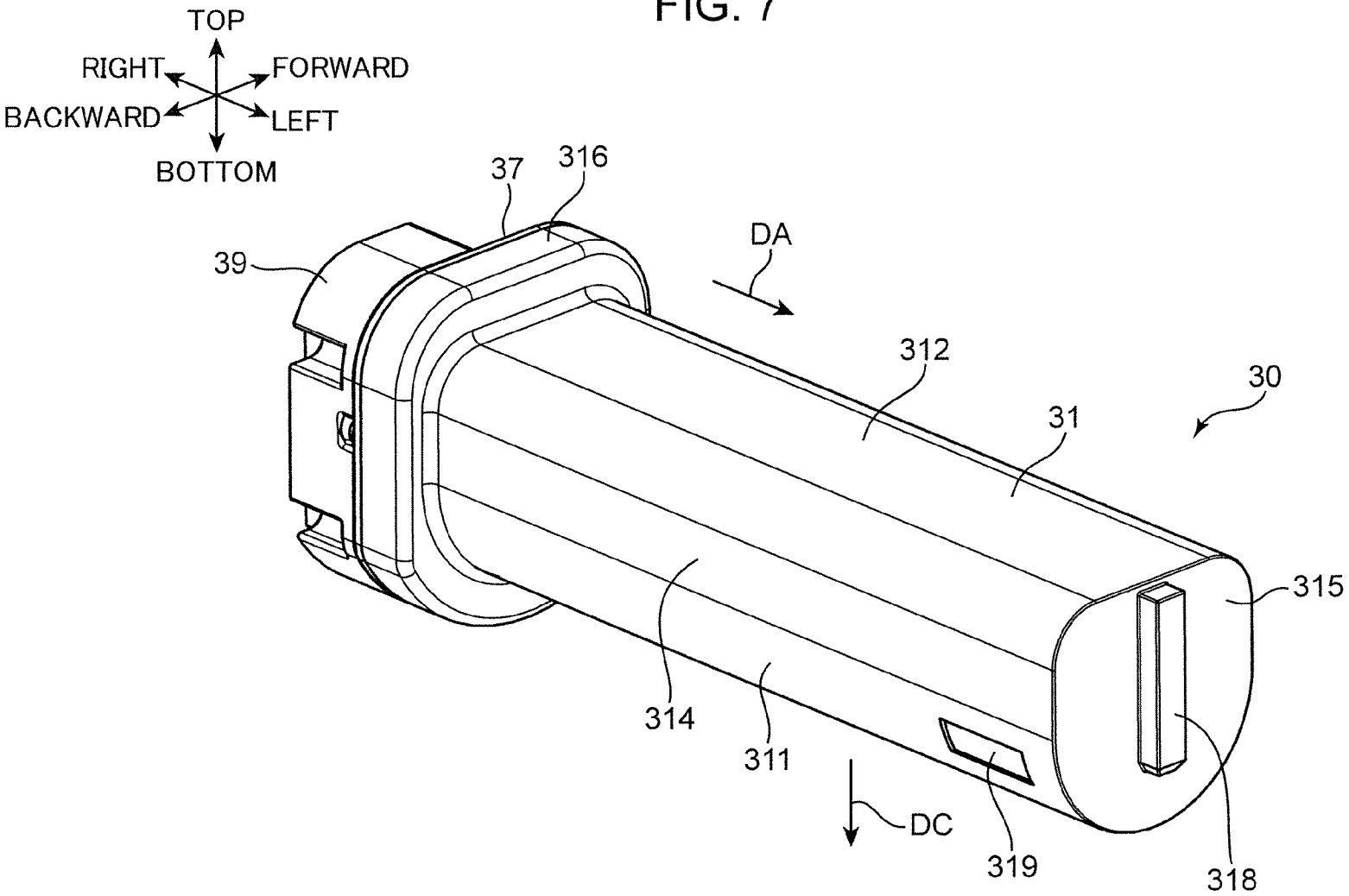
FIG. 7 is a perspective view of the developer container according to the embodiment of the present disclosure.
Figures 8A, 8B, 8C:
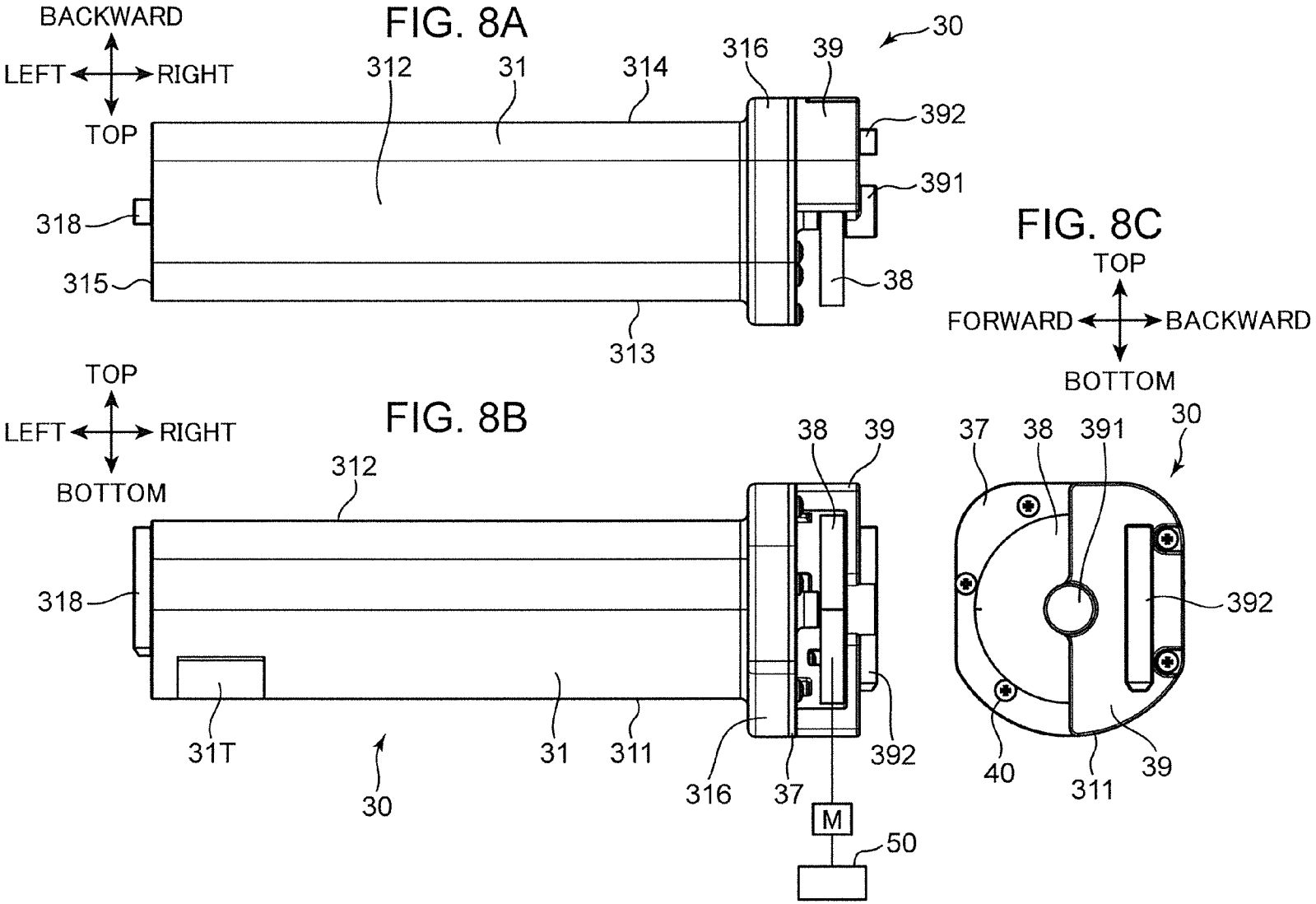
FIG. 8A is a plan view of the developer container according to the embodiment of the present disclosure, FIG. 8B being a front view of the container, and FIG. 8C being a side view of the container.
Figure 9:
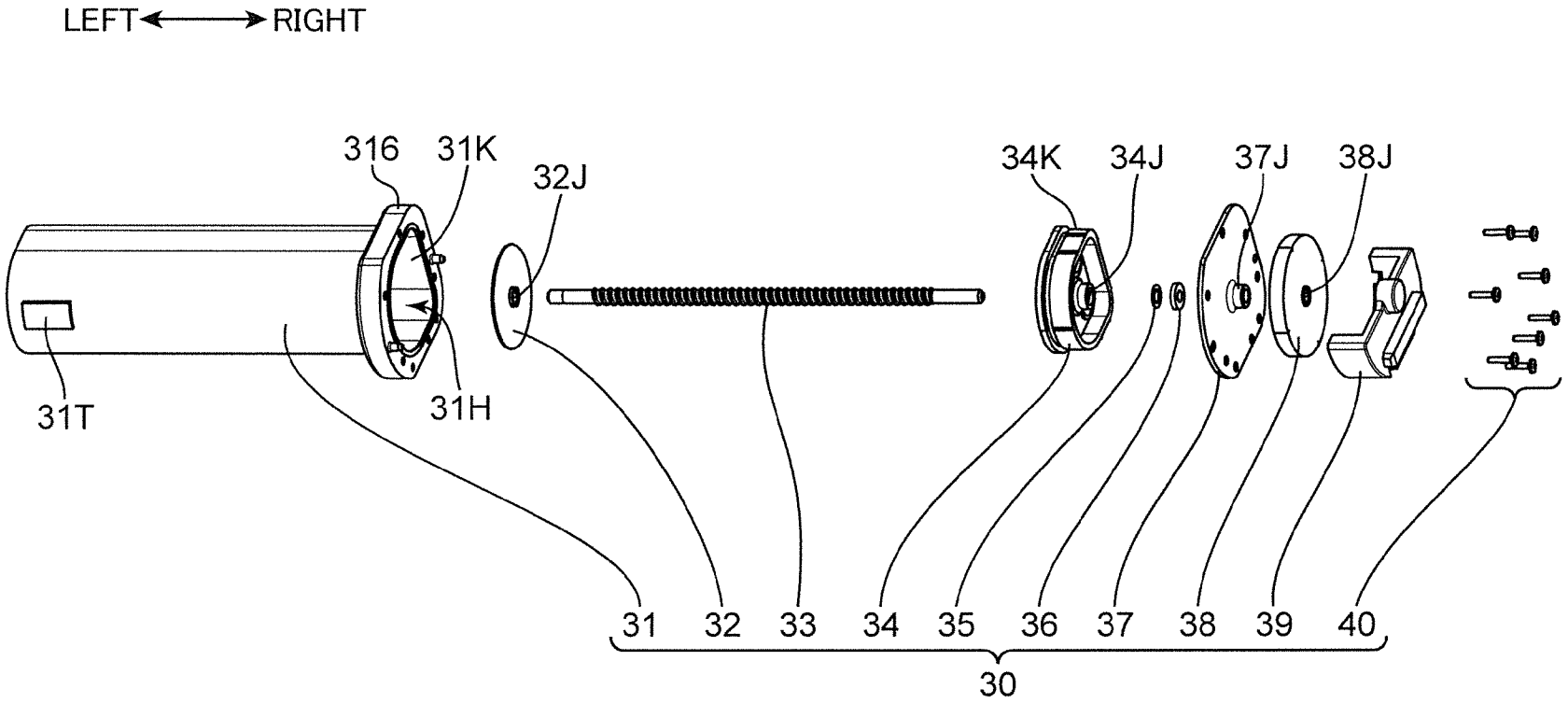
FIG. 9 is an exploded perspective view of the developer container according to the embodiment of the present disclosure.
Figures 10A, 10B:
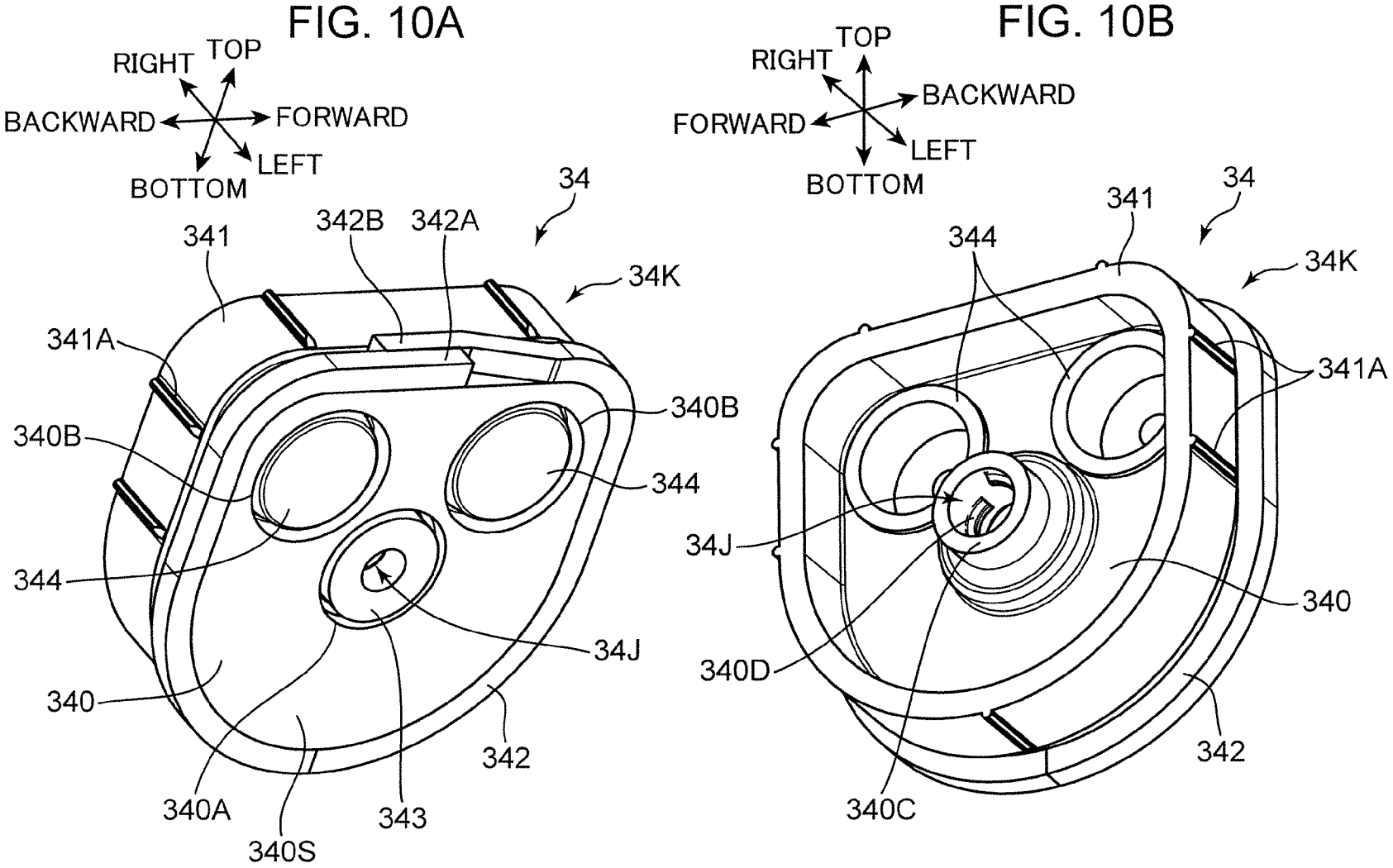
FIG. 10A and FIG. 10B are perspective views of a movable wall of the developer container according to the embodiment of the present disclosure.
Figure 11:
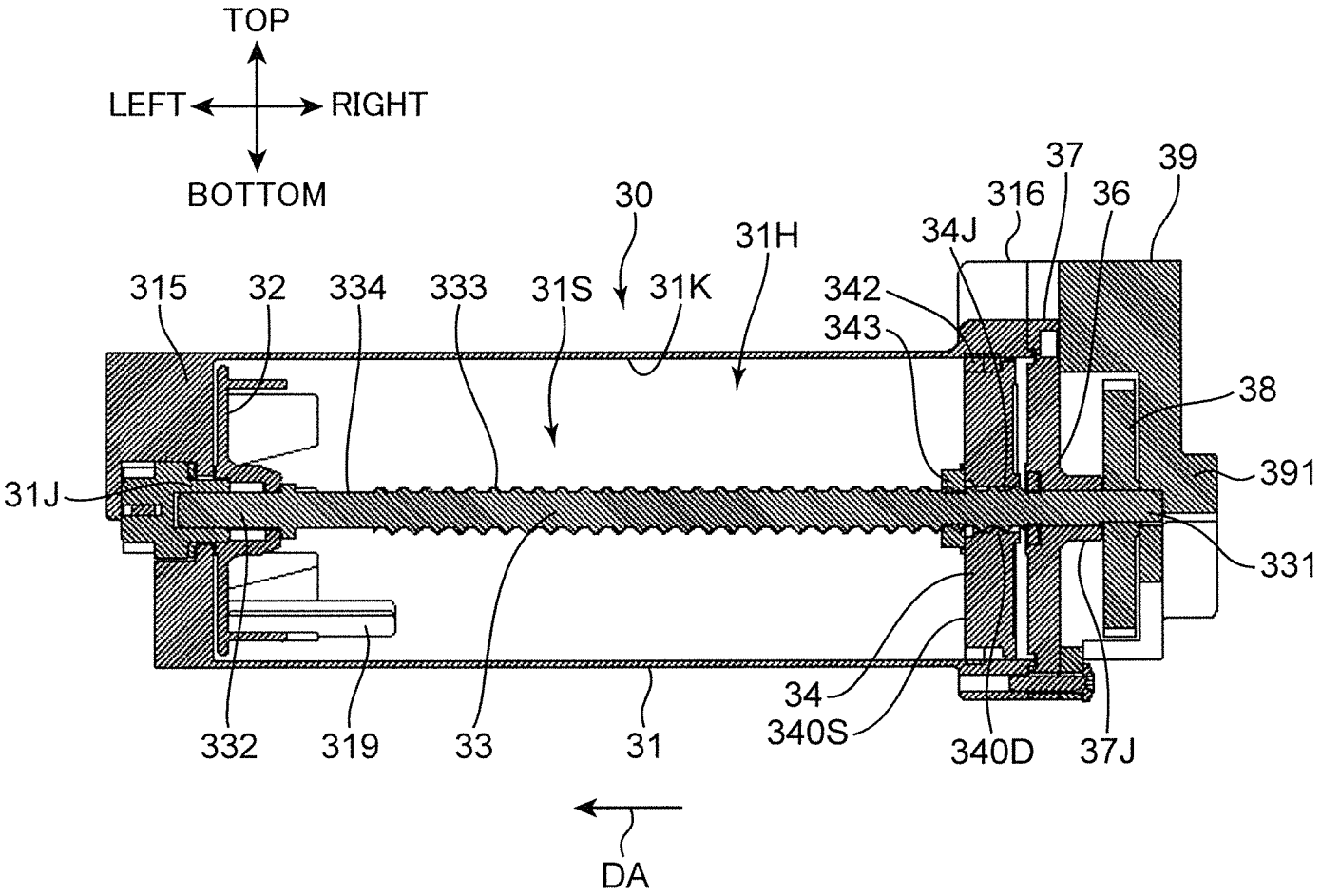
FIG. 11 is a sectional view of the developer container according to the embodiment of the present disclosure.

Now there will be described the toner container 30 (developer container) according to the embodiment of the present disclosure with reference to FIGS. 6 to 11. FIGS. 6 and 7 are perspective views of the toner container 30 according to the present embodiment. FIG. 8A is a plan view of the toner container 30, FIG. 8B being its front view, and FIG. 8C being its side view. FIG. 9 is an exploded perspective view of the toner container 30. FIGS. 10A and 10B are perspective views of a movable wall 34 of the toner container 30. FIG. 11 is a sectional view of the toner container 30.

The toner container 30 is substantially in the form of a cylinder. The toner container 30 contains replenishment toner (developer). With reference to FIGS. 9 and 11, the toner container 30 includes a container body 31 (container body), a rotary stirring member 32, a shaft 33, the movable wall 34, a washer 35 (FIG. 9), a sponge seal 36, a lid 37 (second wall), a rotary gear 38 (drive transmitter), a cover 39, and screws 40 (FIG. 9).

The container body 31 constitutes the body of the toner container 30 and is substantially in the form of a cylinder. The container body 31 includes an inner surface 31K and an internal space 31H (FIGS. 9 and 11). The internal space 31H is in the form of a cylinder extending in a longitudinal direction (in a first direction, the direction of an arrow DA shown in FIGS. 6, 7, and 11) and is defined by the inner surface 31K.

The container body 31 includes the bottom portion 311, a top portion 312, a front wall 313, a rear wall 314, a left wall 315 (first wall), and a flange 316. The bottom portion 311 constitutes the bottom of the container body 31 and is in the form of a half cylinder projecting downward. In other words, the bottom portion 311 has an arc shape in a sectional view perpendicularly intersecting the first direction. The front wall 313 and the rear wall 314 are a pair of side walls standing on the opposite lateral ends of the bottom portion 311. The top portion 312 is disposed above the bottom portion 311 to cover the internal space 31H from above. The left wall 315 joins one end (left end) of each of the bottom portion 311, the front wall 313, the rear wall 314, and the top portion 312 in the first direction, thereby covering the container body 31. The internal space 31H is defined by the bottom portion 311, the top portion 312, the front wall 313, the rear wall 314, and the left wall 315, and also by the lid 37 described later. The internal space 31H includes a storage space 31S defined between the left wall 315 and the movable wall 34 described later. The storage space 31S is a space configured to contain toner in the toner container 30.

As shown in FIG. 9, the container body 31 is open at the right end thereof. The flange 316 defines this opening and has an outer diameter greater than the left end of the container body 31. The flange 316 is attached with the lid 37 described later.

The container body 31 includes an unillustrated shutter, a first guiding portion 318, and the toner discharge port 319 (developer discharge port). The shutter is disposed on an outer surface of the container body 31 at the left end of the container body 31. The shutter can be slid in the first direction. The shutter covers (seals) the toner discharge port 319 from the outside of the container body 31, and exposes the toner discharge port 319 to the outside.

The first guiding portion 318 is in the form of a protrusion vertically extending on the outer surface of the left wall 315. The first guiding portion 318 guides mounting of the toner container 30 into the housing 101 in cooperation with a second guiding portion 392 described later.

The toner discharge port 319 is formed in the bottom portion 311 of the container body 31 and communicates with the internal space 31H (storage space 31S). As shown in FIG. 7, the toner discharge port 319 is formed at the left end of the container body 31. The toner discharge port 319 is disposed at a position higher than the lowest part of the bottom portion 311 of the cylindrical container body 31 by a predetermined amount. The toner discharge port 319 is located below the shaft 33 described later (see FIG. 11). Toner contained in the storage space 31S is discharged through the toner discharge port 319 toward the developing device 20.

The rotary stirring member 32 (FIGS. 9 and 11) (stirring member) is disposed along the left wall 315 at the left end of the storage space 31S and faces the storage space 31S. Further, the rotary stirring member 32 faces the toner discharge port 319 in a direction intersecting the first direction. The rotary stirring member 32 is fixedly attached to a second shaft end portion 332 of the shaft 33 described later, and integrally rotates with the shaft 33. At this time, the rotary stirring member 32 rotates around an axis of the shaft 33 in a rotational direction proceeding from the lowest part of the container body 31 to the developer discharge port 319. The rotary stirring member 32 functions to stir toner around the toner discharge port 319 in the storage space 31S. In other embodiments, the rotary stirring member 32 may be driven for rotation, independently of the shaft 33. In this case, the shaft 33 serves to rotatably and axially support the rotary stirring member 32. The structure of the rotary stirring member 32 will be described in detail later.

The shaft 33 is disposed in the internal space 31H and above the toner discharge port 319, the shaft 33 extending in the first direction and being rotatably supported on the container body 31 and the lid 37 described later. The shaft 33 is rotated around its axis in a first rotational direction and a second rotational direction opposite to the first rotational direction. The shaft 33 includes a first shaft end portion 331, the second shaft end portion 332, a male thread 333 (first engaging portion), and a movable wall stopper portion 334.

The first shaft end portion 331 (FIG. 11) is defined by one end of the shaft 33 in the first direction. The first shaft end portion 331 is axially supported in a lid shaft hole 37J of the lid 37 described later. The second shaft end portion 332 is defined by the other end of the shaft 33 in the first direction. The second shaft end portion 332 is axially supported on a main body bearing 31J (FIG. 11) formed in the left wall 315 of the container body 31. The male thread 333 is in the form of a helical ridge projecting from the outer surface of the shaft 33 and extending in the first direction in the internal space 31H. In the present embodiment, the male thread 333 extends on the shaft 33 from a position facing the flange 316 to a position facing the right end of the toner discharge port 319, as shown in FIG. 11. The movable wall stopper portion 334 is disposed downstream (at the left side) of the male thread 333 in the first direction. The movable wall stopper portion 334 is defined by a specific part of the shaft 33, the specific part not bearing the male thread 333. The movable wall stopper portion 334 is disposed above the toner discharge port 319.

The movable wall 34 is a wall disposed in the container body 31 and extending in a direction perpendicularly intersecting the first direction. The movable wall 34 defines one end surface (right end surface) of the storage space 31S in the first direction. The other end surface (left end surface) of the storage space 31S in the first direction is defined by the left wall 315 and the rotary stirring member 32. During a time period from the beginning to the end of use of the toner container 30, the movable wall 34 moves to the toner discharge port 319 from the right end to the left end of the internal space 31H, along the shaft 33. In the present embodiment, the movable wall 34 can be driven to move only in the left direction by a motor M described later.

With reference to FIGS. 10A and 10B, the movable wall 34 includes a conveying wall portion 340, an outer peripheral wall portion 341, an inner wall seal 342, a shaft seal 343, supply opening caps 344, a movable wall shaft hole 34J, and an outer surface 34K.

The conveying wall portion 340 is a wall defining the storage space 31S in cooperation with the inner surface 31K of the container body 31. In particular, the conveying wall portion 340 includes a conveying surface 340S extending perpendicularly to the shaft 33. The conveying surface 340S conveys toner in the storage space 31S by pressing it in accordance with the movement of the movable wall 34. The conveying wall portion 340 further includes a carrier bearing 340A, toner supply openings 340B, and a cylinder part 340C. The carrier bearing 340A is a bearing formed in a substantially central part of the conveying wall portion 340. The carrier bearing 340A moves in the first direction while holding the movable wall 34. The above-described shaft 33 is inserted in the carrier bearing 340A. The toner supply openings 340B are formed above the carrier bearing 340A to pass through the conveying wall portion 340 in the first direction. Upon attachment of the movable wall 34 to the container body 31, the toner supply openings 340B communicate with the storage space 31S. Replenishment toner is filled into the storage space 31S through the toner supply openings 340B when the toner container 30 is manufactured.

The cylinder part 340C projects from a surface of the conveying wall portion 340 that is opposite to the conveying surface 340S in the first direction. The cylinder part 340C constitutes a part of the carrier bearing 340A. The cylinder part 340C includes a female thread 340D (second engaging portion). The female thread 340D is in the form of a helical ridge projecting from an inner surface of the cylinder part 340C. The female thread 340D functions to move the movable wall 34 in the first direction by engaging (meshing) with the male thread 333 of the shaft 33. At this time, the inner surface of the cylinder part 340C (carrier bearing 340A) comes into engagement with the outer surface of the shaft 33, whereby the position of the movable wall 34 is maintained. Therefore, the conveying wall portion 340 of the movable wall 34 is prevented from tilting with respect to the shaft 33.

The outer peripheral wall portion 341 projects from the outer peripheral edge of the conveying wall portion 340 in a direction away from the storage space 31S, namely, in a direction opposite to the moving direction of the movable wall 34. The outer peripheral wall portion 341 faces the inner surface 31K of the container body 31. The outer peripheral wall portion 341 includes ribs 341A. The ribs 341A are disposed on the outer peripheral wall portion 341 and each extend in the first direction. The ribs 341A are spaced from one another in a circumferential direction of the outer peripheral wall portion 341. The ribs 341A are in slight contact with the inner surface of the 31K, and function to prevent the movable wall 34 from tilting in the first direction in the container body 31.

The inner wall seal 342 is a sealing member disposed on the outer peripheral wall portion 341 on a rear end joining the conveying wall portion 340 in such a way as to ride on a circumference of the rear end of the outer peripheral wall portion 341. As shown in FIG. 10A, the inner wall seal 342 is fixedly attached to the top of the conveying wall portion 340 at a first seal end 342A thereof, and then fixedly wound around the conveying wall portion 340 to be finally fixed at a second seal end 342B thereof in such a manner that the first seal end 342A and the second seal end 342B overlap each other. The inner wall seal 342 is resiliently compressed between the inner surface 31K of the container body 31 and the movable wall 34. The inner wall seal 342 constitutes a part of the outer surface 34K of the movable wall 34. The outer surface 34K is disposed in close contact with the inner surface 31K of the container body 31. The inner wall seal 342 prevents toner in the storage space 31S from flowing out to the upstream side of the movable wall 34 in the moving direction through the gap between the inner surface 31K of the container body 31 and the movable wall 34.

The shaft seal 343 is disposed on the carrier bearing 340A at a downstream side of the female thread 340D in the moving direction of the movable wall 34 (FIG. 11). The shaft seal 343 comes in contact with the male thread 333 of the shaft 33 in accordance with the movement of the movable wall 34. At this time, the shaft seal 343 comes in contact with the male thread 333 earlier than the female thread 340D to clean toner adhered on the male thread 333. This allows the male thread 333 to engage with the female thread 340D after toner adhered thereon is removed almost completely. This makes it possible to prevent toner from aggregating between the male thread 333 and the female thread 340D and therefore to allow stable movement of the movable wall 34. In addition, the shaft seal 343 is in the form of a ring allowing the shaft 33 to pass therethrough, and is therefore in close contact with the shaft 33 over the entire circumference of the shaft 33. This prevents toner in the storage space 31S from flowing out to the upstream side of the movable wall 34 in the moving direction through the carrier bearing 340A. The movable wall shaft hole 34J is formed radially inside the shaft seal 343 in the form of a ring and the cylinder part 340C, the movable wall shaft hole 34J for allowing the shaft 33 to pass therethrough.

The supply opening caps 344 are fitted in the toner supply openings 340B through the inside of the outer peripheral wall portion 341 to seal the toner supply openings 340B, as shown in FIG. 10B. After replenishment toner is filled in the container space 31S through the toner supply openings 340B, the supply opening caps 344 are respectively fitted into the toner supply openings 340B. This makes it possible to prevent toner from leaking through the toner supply openings 340B.

The washer 35 (FIG. 9) is fitted on the shaft 33 between the cylinder part 340C of the movable wall 34 and the sponge seal 36.

The sponge seal 36 is disposed between the washer 35 and the lid 37. The sponge seal 36 prevents toner from leaking through the lid shaft hole 37J of the lid 37 described later, with the lid 37 being fixedly attached to the container body 31.

The lid 37 (FIGS. 9 and 11) is fixedly attached to the flange 316 of the container body 31 and seals the opening of the container body 31, thereby defining the other end surface of the internal space 31H. The lid 37 includes the lid shaft hole 37J (FIG. 9). The shaft 33 is rotatably and axially supported in the lid shaft hole 37J at the first shaft end 331.

The rotary gear 38 is fixedly attached to the first shaft end portion 331 of the shaft 33. A tip end of the first shaft end portion 331 is in the shape of D in a sectional view perpendicularly intersecting its axial direction (see FIG. 13). The rotary gear 38 is formed with an unillustrated D hole in a central part thereof, the D hole engaging with the tip end of the first shaft end portion 331 having the D-shape. This allows the rotary gear 38 to integrally rotate with the shaft 33. The rotary gear 38 includes outer peripheral gear teeth 381 (FIG. 6). The outer peripheral gear teeth 381 are formed in an outer peripheral portion of the rotary gear 38. The outer peripheral gear teeth 381 are not shown in the drawings. The rotary gear 38 is connected to the motor M (FIG. 8B) (driver) disposed in the housing 101 of the printer 100. Upon receipt of a torque from the motor M, the rotary gear 38 transmits the torque to the shaft 33 to move the movable wall 34 in the first direction.

The cover 39 is disposed at the right end of the toner container 30. With reference to FIG. 8C, the cover 39 has such a shape to cover a half of the circular side face of the rotary gear 38. In other words, upon fixed attachment of the cover 39 to the container body 31 via the lid 37, the other half of the circular side face of the rotary gear 38 is exposed to the outside of the toner container 30. The cover 39 includes a shaft cover portion 391 and the second guiding portion 392. The shaft cover portion 391 is formed in a central part of the cover 39 and is in the form of a cylinder. The shaft cover portion 391 covers the end of the first shaft end portion 331 projecting from the rotary gear 38. The second guiding portion 392 is in the form of a protrusion vertically extending and lying behind the shaft cover portion 391. The second guiding portion 392 functions to guide mounting of the toner container 30 into the printer 100.

Each of the screws 40 is fastened to the flange 316 of the container body 31 after being inserted into unillustrated screw holes respectively formed in the lid 37 and the cover 39. Consequently, the container body 31, the lid 37, the rotary gear 38, and the cover 39 constitute an integral structure, with the rotary stirring member 32, the shaft 33, and the movable wall 34 being disposed in the internal space 31H.

Further, the toner container 30 includes a toner sensor 31T (FIGS. 6 and 8B). The toner sensor 31T is disposed on the bottom portion 311 of the container body 31. The toner sensor 31T extends from the lowest part of the bottom portion 311 along the arc-shaped surface of the bottom portion 311. The toner sensor 31T faces the toner discharge port 319 in a circumferential direction of the toner container 30. Further, in the present embodiment, the toner discharge port 319 is disposed above the lowest part of the bottom portion 311 as mentioned above. This allows the toner sensor 31T to be disposed at or around the lowest part of the bottom portion 311.

The toner sensor 31T includes a magnetic permeability sensor or a piezoelectric element. In the case where the toner sensor 31T includes a piezoelectric element, a sensing portion of the toner sensor 31T is exposed to the storage space 31S. The toner sensor 31T outputs a HIGH signal (+5V) in response to being pressed by toner in the storage space 31S. Further, when no toner exists directly above the toner sensor 31T, the toner sensor 31T outputs a LOW signal (0V). A signal outputted by the toner sensor 31T is referred to by a controller 50 described later. In the case where the toner sensor 31T includes a magnetic permeability sensor, the sensor does not need to make direct contact with toner. Therefore, in other embodiments, the toner sensor 31T may be disposed on the housing 101 of the printer 100 in such a manner as to face the outer surface of the container body 31. Further, the toner sensor 31T is not limited to be disposed on the bottom portion 311. In other embodiments, the toner sensor may be disposed on any one of the top portion 312, the front wall 313, and the rear wall 314 near the toner discharge port 319.

Figure 12:
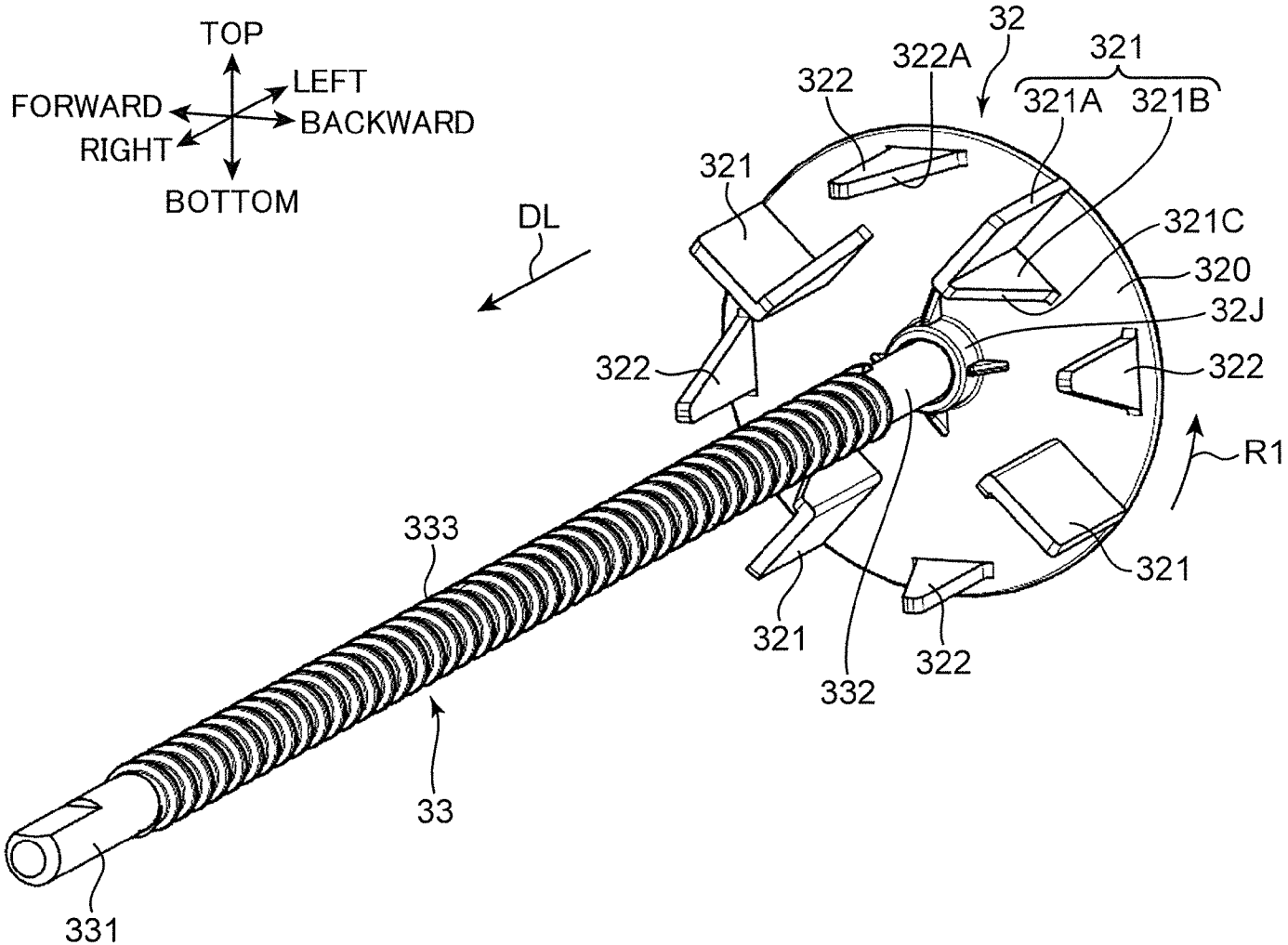
FIG. 12 is a perspective view of a shaft and a stirring member according to the embodiment of the present disclosure.
Figure 13:
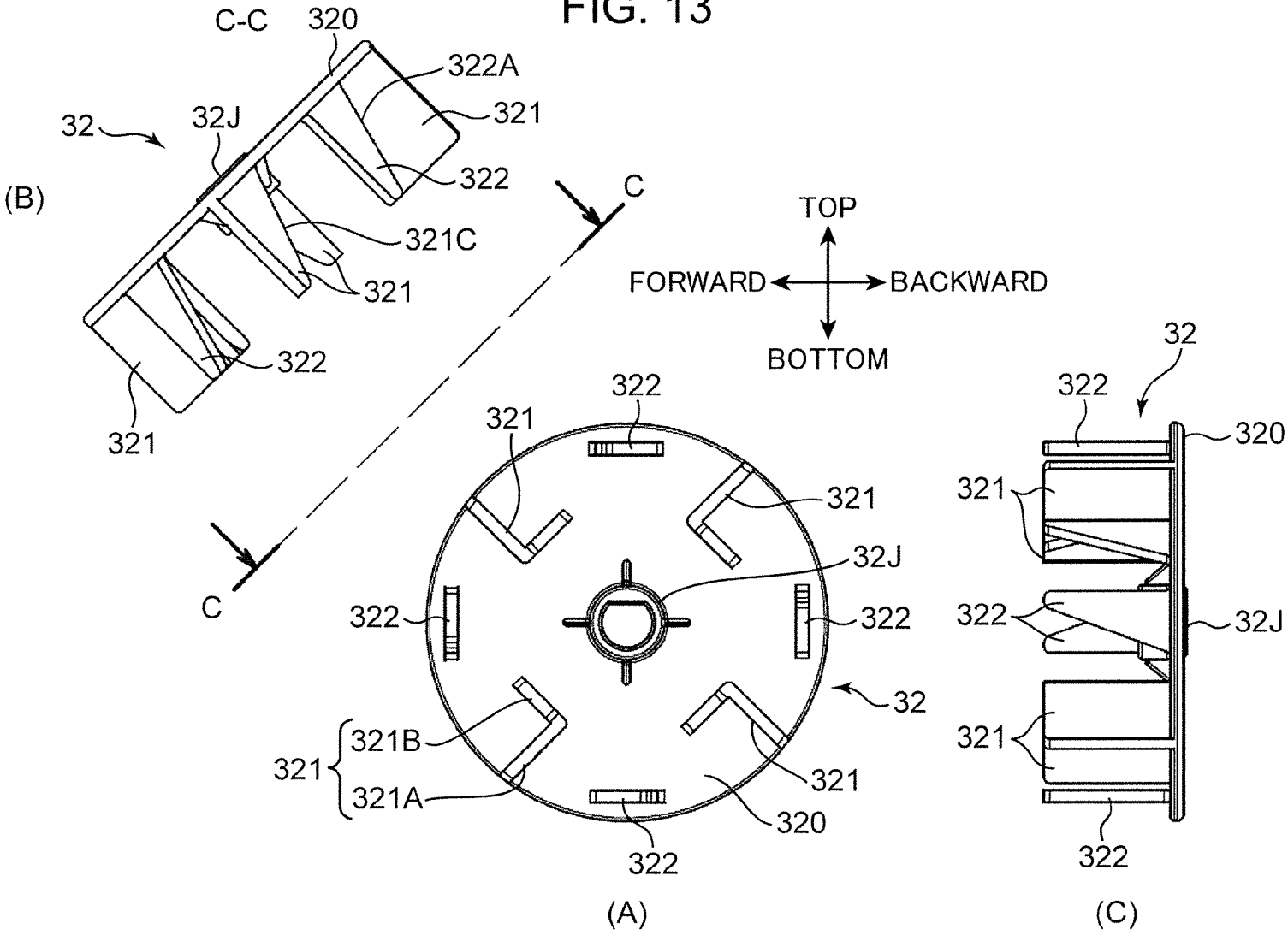
FIG. 13 includes a front view and side views of the stirring member according to the embodiment of the present disclosure.

Now, the rotary stirring member 32 of the toner container 30 according to the present embodiment will be described in detail with reference to FIGS. 12 and 13. FIG. 12 is a perspective view of the shaft 33 and the rotary stirring member 32 of the toner container 30. FIG. 13 includes a front view and side views of the rotary stirring member 32. A section (A) of FIG. 13 shows a front view of the rotary stirring member 32 and sections (B) and (C) of FIG. 13 show side views of the rotary stirring member 32, the section (B) showing a side view of the rotary stirring member 32 as seen in the direction of arrows C (from the upper front), and the section (C) showing a right side view of the rotary stirring member 32.

The rotary stirring member 32 is integrally rotated with the shaft 33 in the direction of an arrow R1 shown in FIG. 12. The rotary stirring member 32 includes a disc plate 320 (disc portion), first projecting portions 321 (projecting portion, projecting piece) and second projecting portions 322 (projecting portion, projecting piece, second plate-shaped member).

The disc plate 320 is a disc-shaped member and is secured (axially supported) on the second shaft end portion 332 of the shaft 33. The disc plate 320 includes a disc shaft hole 32J formed in a central portion thereof, the disc shaft hole 32J allowing the second shaft end portion 322 to pass therethrough. The first projecting portions 321 and the second projecting portions 322 are constituted by projecting pieces which are disposed on the disc plate 320 at intervals from one another in a circular direction. These projecting pieces extend from the disc plate 320 in the storage space 31S. These projecting pieces move on a circular path according to rotation of the rotary stirring member 32, the circular path lying inside the toner discharge port 319.

Each of the first projecting portions 321 includes a projection 321A (first plate-shaped member) and a projection 321B (second plate-shaped member). The projection 321B is in the form of a plate extending in a direction intersecting a radial direction of the rotary stirring member 32 and faces the disc shaft hole 32J. The projection 321B has an oblique surface 321C. The oblique surface 321C is defined by an upstream side surface of the projection 321B in the rotational direction of the rotary stirring member 32, the oblique surface 321C sloping upward in the rotational direction. The projection 321A joins a downstream end of the projection 321B in the rotational direction, a direction along the projection 321A intersecting a direction along the projection 321B at a predetermined angle. The projection 321A is in the form of a plate intersecting the rotational direction of the rotary stirring member 32, i.e. extending outward in the radial direction. A radially outer surface of the projection 321A is flush with the outer surface of the disc plate 320 in an axial direction of the shaft 33.

Each of the second projecting portions 322 has a similar shape to that of the projection 321B and is disposed between circularly adjacent first projecting portions 321. In other words, the first projecting portions 321 and the second projecting portions 322 are disposed alternately in the circular direction. The second projecting portions are disposed in closer proximity to the periphery of the disc plate 320 than the twelfth projections 321B are. The second projecting portion 322 has an oblique surface 322A, similarly to the projection 321B. With reference to the section (A) of FIG. 13, one and another of the first projecting portions 321 are disposed symmetrically to each another with respect to the axis of the shaft 33 passing through the disc shaft hole 32J, and one and another of the second projecting portions 322 are disposed symmetrically to each other with respect to the axis of the shaft 33.

<Function of Toner Container>

As described above, the toner container 30 can be attached to and detached from the housing 101. With reference to FIG. 2, when the opening/closing cover 100C of the housing 101 is opened upward, a container housing space 109 is exposed to the outside of the housing 101, the container housing space 109 constituting a part of the main body internal space 107. In the present embodiment, the toner container 30 is mounted in the container housing space 109 from above (see an arrow DC shown in FIGS. 6 and 7). At this time, the cover 39 of the toner container 30 comes to rest at the right end of the container housing space 109, and the left wall 315 of the toner container 30 comes to rest at the left end of the container housing space 109. The printer 100 includes guide grooves 109A (FIG. 2). The guide grooves 109A are grooves vertically extending in the container housing space 109. Although FIG. 2 shows only a right guide groove 109A, there is also a left guide groove 109A similarly disposed at the left end of the container housing space 109.

The toner container 30 is mounted into the container housing space 109 by a user, with the first guiding portion 318 and the second guiding portion 392 respectively engaging with the pair of guide grooves 109A. When the toner container 30 is mounted in the container housing space 109, a user or an unillustrated opening/closing mechanism slides the shutter to open the toner discharge port 319. Consequently, the toner discharge port 319 lies above and faces the toner supply port 25 (FIGS. 4 and 5). In addition, an unillustrated guiding wall extends between the toner discharge port 319 and the toner supply port 25, which allows toner falling through the toner discharge port 319 to be entirely flow into the toner supply port 25.

Figure 14A:
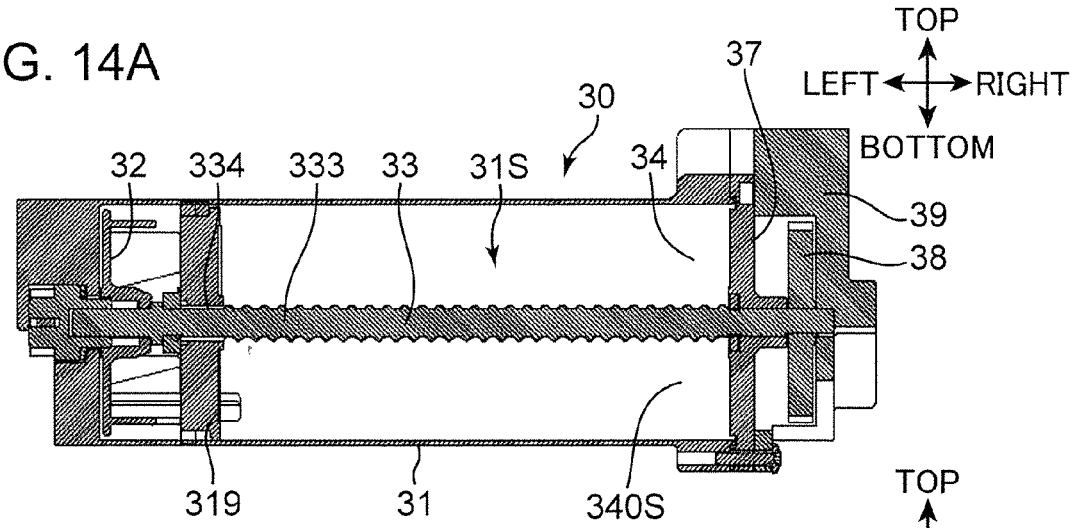
FIG. 14A, FIG. 14B, and FIG. 14C are sectional views illustrating movement states of the movable wall in the developer container according to the embodiment of the present disclosure.
Figure 14B:
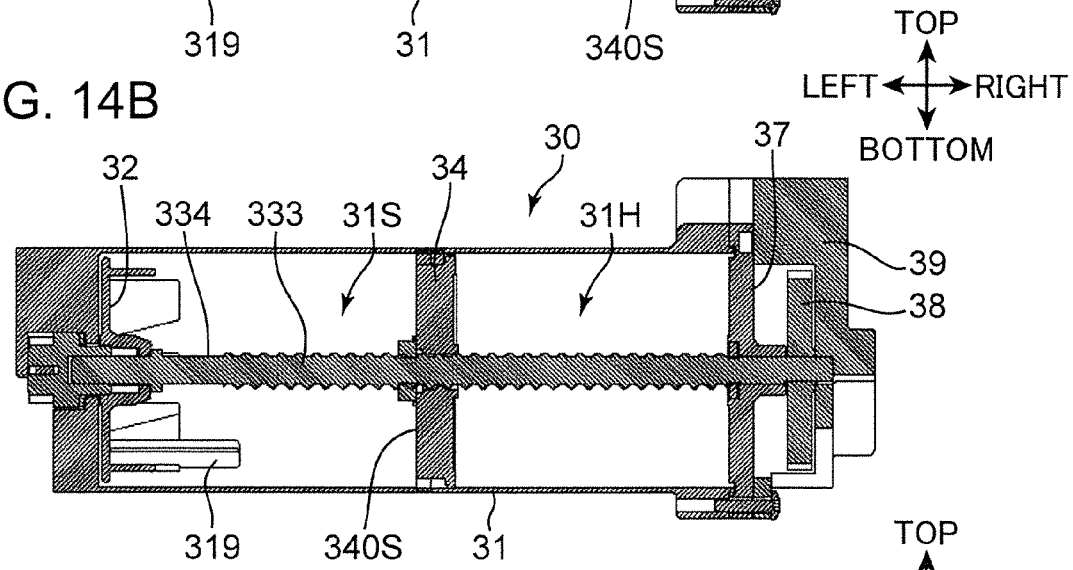
Figure 14C:
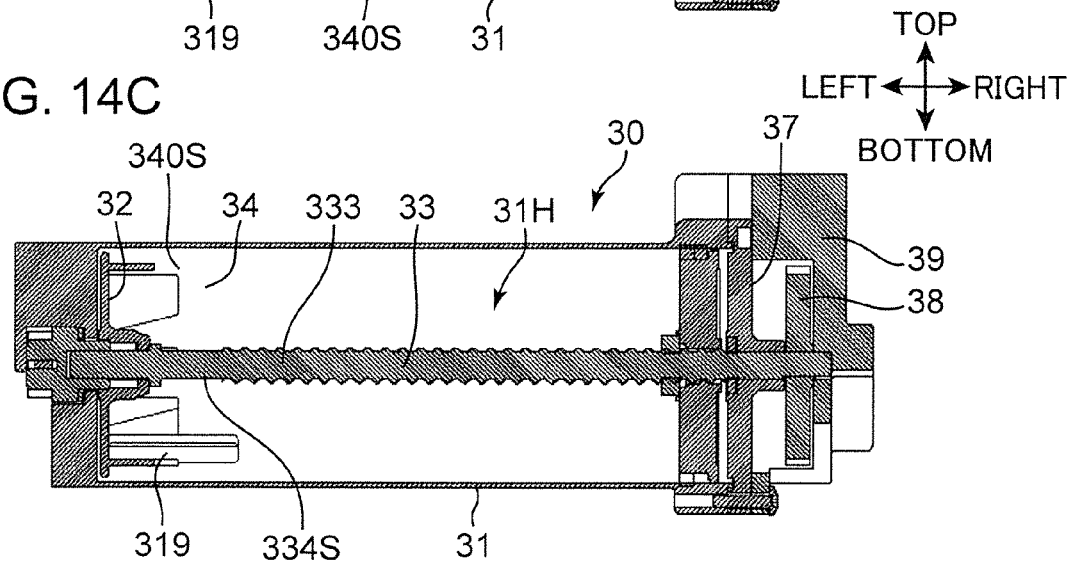
Figure 15:
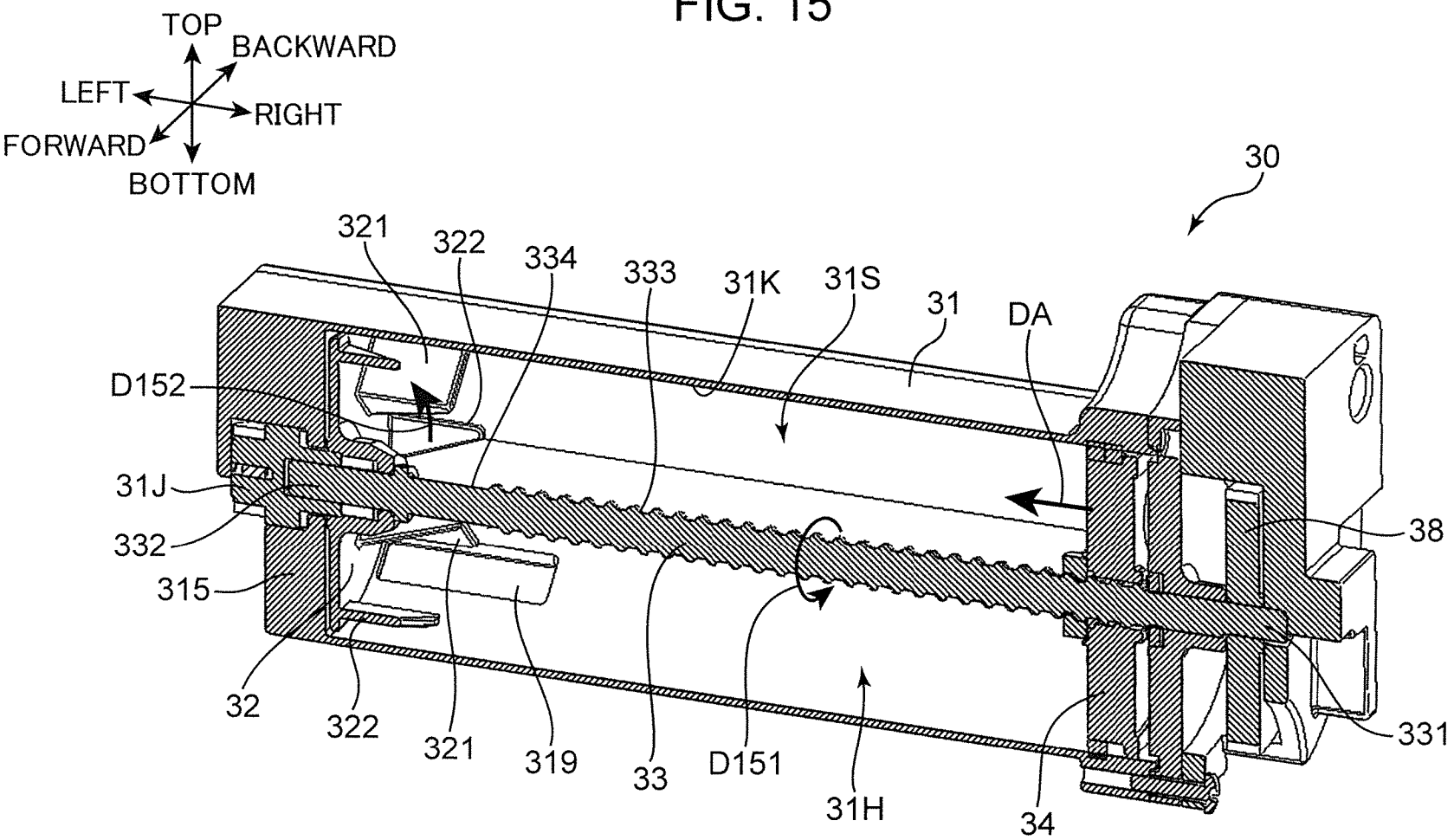
FIG. 15 is a sectional perspective view of the developer container according to the embodiment of the present disclosure.
Figure 16:
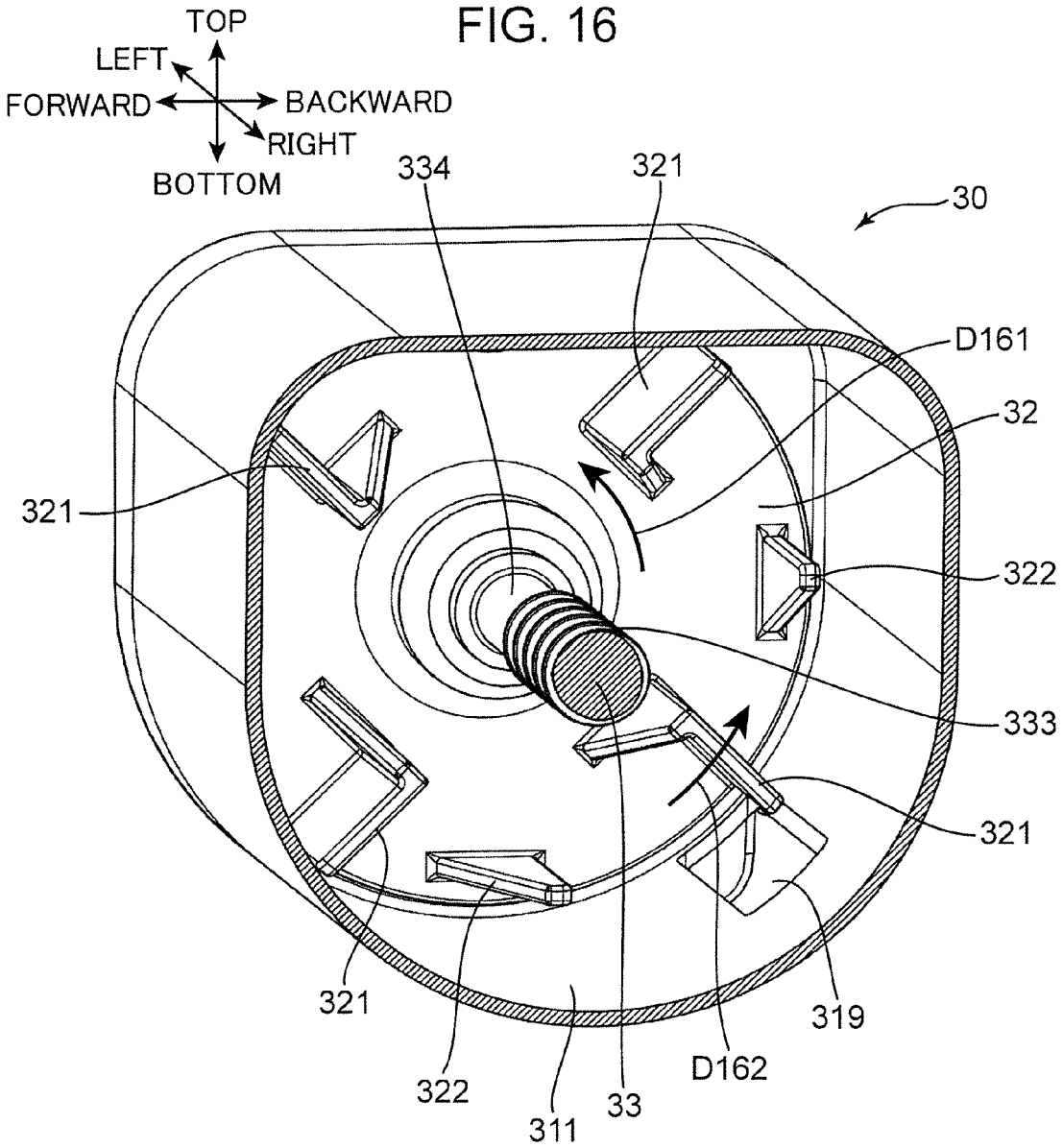
FIG. 16 is a sectional perspective view of the developer container according to the embodiment of the present disclosure.

FIGS. 14A, 14B, and 14C are sectional views illustrating the movement of the movable wall 34 in the toner container 30. FIG. 14A shows the movable wall 34 located at an initial position. FIG. 14B shows the movable wall 34 having moved from the initial position in the first direction. FIG. 14C shows the movable wall 34 located at a final position. FIG. 15 is a sectional perspective view showing the inside of the toner container 30. FIG. 16 is a sectional perspective view showing the rotary stirring member 32 and the toner discharge port 319 and the vicinity thereof of the toner container 30.

As shown in FIGS. 14A and 15, when the toner container 30 is newly mounted in the printer 100 by a user, the movable wall 34 is at the initial position adjacent to the lid 37, the initial position being remote from the toner discharge port 319. Even if the storage space 31S is maximally filled with toner when the toner container 30 is manufactured, a slight space will remain in the storage space 31S. This space is necessary to impart a predetermined fluidity to the toner contained in the storage space 31S before use of the toner container 30. Accordingly, when the toner container 30 is newly mounted in the printer 100, the controller 50 (FIG. 8B) provided in the printer 100 causes the motor M to drive the rotary gear 38 and the shaft 33 for rotation (see the direction of an arrow D151 shown in FIG. 15) for a predetermined period of time. This brings the male thread 333 into engagement with the female thread 340D to thereby move the movable wall 34 in the first direction toward the toner discharge port 319 (see the direction of an arrow DA shown in FIG. 15).

In the present embodiment, the inner surface 31K of the container body 31 and the outer surface 34K (outer peripheral wall portion 341) of the movable wall 34 each have, in a sectional view perpendicularly intersecting the first direction, a non-true circular shape. This makes it possible to prevent the movable wall 34 from rotating with respect to the container body 31 even when the movable wall 34 receives a force for rotation around the shaft 33, owing to the engagement of the male thread 333 and the female thread 340D. Consequently, it is possible to move the movable wall 34 stabilizedly in the first direction by a torque of the motor M. In addition, the engagement of the male thread 333 and the female thread 340D makes it possible to move the movable wall 34 stabilizedly in the first direction with the outer surface 34K of the movable wall 34 being in close contact with the inner surface 31K of the container body 31 as described above.

As described above, the present embodiment employs the volume replenishment type toner supply method as shown in FIG. 5. Therefore, when the toner supply port 25 is sealed by the accumulation portion 29 (FIG. 5) located in the developing device 20 from below, no replenishment toner falls from the toner container 30. On the other hand, when the amount of toner of the accumulation portion 29 has decreased due to supply of toner from the developing roller 21 of the developing device 20 to the photoconductive drum 121, toner flows into the developing device 20 from the toner discharge port 319 through the toner supply port 25. Consequently, toner that has existed in the portion facing the toner sensor 31T disappears in the storage space 31S of the toner container 30, which causes the toner sensor 31T to output the LOW signal. Upon receipt of the LOW signal, the controller 50 causes the motor M to run to move the movable wall 34 toward the toner discharge port 319 (FIG. 14B) until the toner sensor 31T outputs the HIGH signal.

In the present embodiment, the rotary stirring member 32 disposed at the left end of the storage space 31S rotates with the shaft 33 (in the direction of an arrow D161 shown in FIG. 16). In particular, the plurality of first projecting portions 321 and second projecting portions 322 circularly move around the shaft 33, which allows toner around the toner discharge port 319 to be positively stirred. At this time, it is possible to raise toner existing at the lowest part of the bottom portion 311 of the container body 31 to the toner discharge port 319 by the circular movement of the eleventh projections 321A (FIG. 12) of the first projecting portions 321 (in the direction of an arrow D162 shown in FIG. 16). Therefore, even in the case where the toner discharge port 319 is disposed above the lowest part of the container body 31 as in the present embodiment, it is possible to efficiently discharge toner existing around the lowest part of the container body 31. This makes it possible to prevent toner from aggregating (being likely to stay) around the toner discharge port 319 as compared with the case of discharging toner only by a conveying force of the movable wall 34. Further, owing to the high toner discharging ability, the toner discharge port 319 is allowed to have a small opening area. This makes it possible to prevent blowout of toner and, consequently, toner stains around the toner discharge port 319 as compared with the case of the toner discharge port 319 having a large opening area.

When toner has been consumed from the storage space 31S of the toner container 30, the movable wall 34 finally comes to the final position near the toner discharge port 319, as shown in FIG. 14C. When the movable wall 34 has reached the toner discharge port 319, the conveying surface 340S of the movable wall 34 comes to face the rotary stirring member 32 in proximity to the rotary stirring member 32. In particular, in the present embodiment, the conveying surface 340S comes into contact with front ends of the first projecting portions 321 and the second projecting portions 322 of the rotary stirring member 32. In this manner, the movable wall 34 gradually moves in the first direction to thereby convey toner in the storage space 31S to the toner discharge port 319 while pressing it. At this time, the storage space 31S gradually decreases as the movable wall 34 approaches the toner discharge port 319. This allows the space accommodating the remaining toner to gradually disappear in the toner container 30. Finally, at the final position shown in FIG. 14C, the movable wall 34 comes into contact with the rotary stirring member 32, so that the storage space 31S almost disappears. This makes it possible to reduce the amount of toner remaining in the storage space 31S of the container body 31 at the end of use of the toner container 30 as compared with the conventional toner container whose storage space volume does not change. Further, because the conveying surface 340S of the movable wall 34 comes into contact with the front ends of the first projecting portions 321 and the second projecting portions 322, a slight amount of toner remaining in the gap between the conveying surface 340S and the disc plate 320 is discharged through the toner discharge port 319 by the circular movement of the first projecting portions 321. Therefore, it is possible to efficiently discharge the toner in the toner container 30.

When the movable wall 34 has reached the final position facing the toner discharge port 319, the outer surface 34K of the movable wall 34 covers a part of the toner discharge port 319 from the inside of the container body 31 (FIG. 14C). When the amount of toner remaining in the toner container 30 has decreased, it is difficult to tell the amount of remaining toner by the weight of the toner container 30. The present embodiment allows a user to open an unillustrated shutter to see if the movable wall 34 is exposed to the outside via the toner discharge port 319, and confirm that toner has run out if the movable wall 34 is exposed. Consequently, the user can be prompted to replace the toner container 30.

Further, the above-described function of the movable wall 34 of partially sealing the toner discharge port 319 can be also utilized in the case where a toner container 30 that has been partially used is dismounted from the printer 100 for some reason and stored with other empty toner containers 30. Specifically, a user is only required to choose a specific one of the plurality of stored toner containers 30, the specific one in which the movable wall 34 is not seen through the toner discharge port 319.

In addition, in the present embodiment, the toner supply openings 340B for filling toner into the storage space S are formed in the movable wall 34 when the toner container 30 is manufactured, as described above. Therefore, there is no need to form a filling port in the container body 31 in addition to the toner discharge port 319. Therefore, it is possible to form the container body 31 in a simple shape. There may be provided toner containers 30 filled with different amounts of toner by varying the initial position of the movable wall 34 in the first direction. It is possible to change the volume of the storage space 31 by changing the initial position of the movable wall 34 at the time of filling toner. Also in this case, the toner supply openings 340B are formed in the movable wall 34 of each of the toner containers 31 and, therefore, it is not necessary to form a filling port in a container body 31 of each of the toner containers 30 at different positions from one another according to the amount of toner to be filled. This allows common use of a single container body 31 for each of the toner containers 31. Even in the case where toner containers 30 are filled with different amounts of toner, the initial position of the movable wall 34 of each of the toner containers 30 may be commonly set at a position shown in FIG. 14A. In this case, when the toner container 30 is mounted in the printer 100, a driving time for allowing the motor M to run is adjusted according to an output signal of the toner sensor 31T as an initial setting, so that the storage space 31S is filled up with toner.

Further, as shown in FIGS. 11 and 14A, the toner container 30 according to the present embodiment includes the movable wall stopper portion 334. The movable wall stopper portion 334 is defined by a specific part of the shaft 33, the specific part not bearing the male thread 333 and facing the toner discharge port 319, as described above. Therefore, the female thread 340D (FIG. 10B) of the movable wall 34 is disengaged from the male thread 333 and comes to face the movable wall stopper portion 334 immediately before the movable wall 34 reaches the final position shown in FIG. 14C. In other words, once the movable wall 34 has reached the final position shown in FIG. 14C, the female thread 340D is prevented from engaging with the male thread 333 again. Consequently, the movable wall 34 will never move back toward the lid 37 even if the rotary gear 38 is inversely rotated by mistake. Therefore, as described above, it is possible to reliably locate the movable wall 34 at the final position when the toner in the toner container 30 has run out. Further, even in the case where a used toner container 30 is stored in a vertical orientation so that the first direction agrees with a vertical direction, the movable wall 34 is prevented from moving back toward the lid 37 by its own weight.

Further, at the final position shown in FIG. 14C, the inner wall seal 342 (FIG. 11) of the movable wall 34 resiliently biases the inner surface 31K of the toner container 30 radially from the inside of the inner surface 31K. Therefore, the movable wall 34 is stably locked at the final position to be further prevented from moving backward.

The toner container 30 and the printer 100 including the same according to the embodiment of the present disclosure have been described above. However, the present disclosure is not limited to the above-described embodiment and, for example, the following modified embodiments may be adopted.

(1) In the above-described embodiment, the printer 100 is illustrated as a monochrome printer. However, the present disclosure is not limited to this configuration. In particular, in the case where the printer 100 is provided as a tandem color printer, after the opening/closing cover 100C (FIG. 2) of the printer 100 is opened, toner containers 30 respectively corresponding to a plurality of colors may be mounted into the housing 101 from above so as to be adjacent to one another.

(2) In the above-described embodiment, the toner container 30 is mounted into the printer 100 in the longitudinal direction of the developing device 20. However, the present disclosure is not limited to this configuration. It may be configured such that the toner container 30 is mounted in a direction intersecting the longitudinal direction of the developing device 20.

(3) In the above-described embodiment, the rotary stirring member 32 is disposed along the left wall 315, and the movable wall 34 moves from a position closer to the lid 37 to a position closer to the left wall 315. However, the present disclosure is not limited to this configuration. In other embodiments, the rotary stirring member 32 may be disposed along the lid 37, and the movable wall 34, which is disposed at the initial position adjacent to the left wall 315 in advance, may be made to move to a position closer to the lid 37. In this case, the toner discharge port 319 is formed near the flange 316 of the container body 31.

(4) The above-described embodiment employs the volume replenishment type toner supply method. However, the present disclosure is not limited to this method. The developing device 20 may further include an unillustrated toner sensor. When the toner sensor has detected that toner in the developing device 20 has decreased, the controller 50 causes the motor M to run to move the movable wall 34 in the first direction. Consequently, toner is caused to fall through the toner discharge port 319 to flow into the developing device 20.

(5) In the above-described embodiment, the carrier bearing 340A is disposed in the central part of the movable wall 34. However, the present disclosure is not limited to this configuration. The carrier bearing 340A may be disposed in another area of the movable wall 34. It may be configured such that the carrier bearing 340A is disposed in an upper part of the movable wall 34, and the shaft 33 correspondingly extends in an upper part of the container body 31. In this case, pressure of toner that is exerted on the shaft seal 343 (FIG. 10A) is low. This allows the shaft seal 343 to maintain the sealing ability at a high level.

Figure 17:
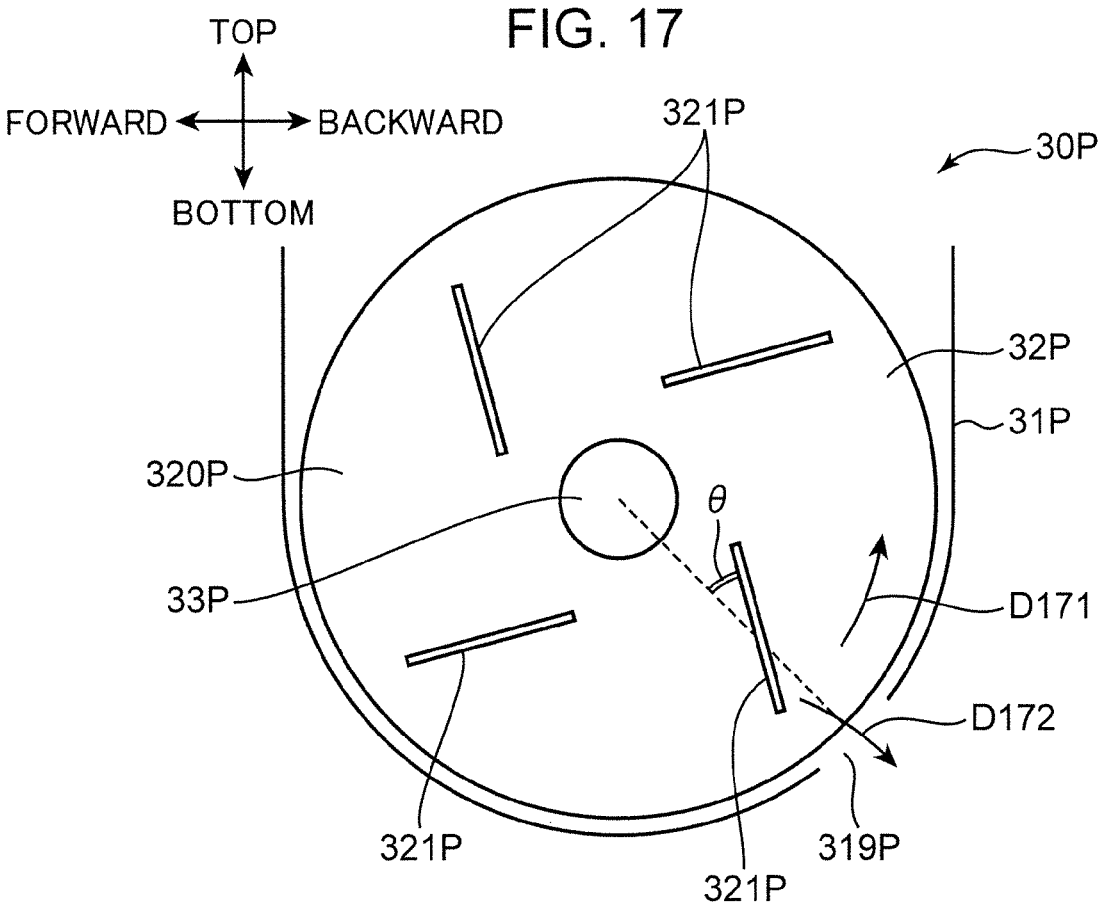
FIG. 17 is a schematic sectional view of a developer container according to another embodiment of the present disclosure.

(6) In the above-described embodiment, the projection 321A of the first projecting portion 321 of the rotary stirring member 32 extends in the radial direction. However, the present disclosure is not limited to this configuration. FIG. 17 is a schematic sectional view showing an inside of a toner container 30P according to a modified embodiment of the present disclosure. The toner container 30P includes a container body 31P, a rotary stirring member 32P (stirring member) and a shaft 33P which have functions identical to those of the corresponding elements of the toner container 30 in the above-described embodiment. The container body 31P is formed with a toner discharge port 319P. In the present modified embodiment, the rotary stirring member 32P includes third projecting portions 321P (projecting portion, first plate-shaped member). Each of the third projecting portions 321P extends from a disc plate 320P in a storage space of the container body 31P. As shown in FIG. 17, the third projecting portion 321P is oblique to a radial direction, its radially inner end part being positioned more downstream in a rotational direction of the rotary stirring member 32P (in the direction of an arrow D172 shown in FIG. 17) than its radially outer end part. Such configuration makes it possible to effectively discharge toner raised by the third projecting portions 321P through a toner discharge port 319P (in the direction of an arrow D172 shown in FIG. 17). In the case where the oblique angle (θ shown in FIG. 17) of the third projecting portion 321P with respect to the radial direction of the rotary stirring member 32P (broken line shown in FIG. 17) is too large, toner may aggregate between the third projecting portion 321P and the bottom portion of the container body 31P. Accordingly, the oblique angle θ of the third projecting portions 321P is preferred to be set at 45 degrees or less. Further, as shown in FIG. 17, elements corresponding to the second projecting portions 322 of the above-described embodiment may be omitted.

(7) In the above-described embodiment, when the movable wall 34 has reached the toner discharge port 319, the outer surface 34K of the movable wall 34 covers a part of the toner discharge port 319 from the inside of the container body 31 (FIG. 14C). However, the present disclosure is not limited to this configuration. The final position where the movable wall 34 stops may be made to lie just before the toner discharge port 319. In other words, the condition that the movable wall 34 has reached the toner discharge port 319" in the present disclosure is satisfied when the movable wall 34 has come to rest in the vicinity of the toner discharge port 319 in the first direction. In this case, the movable wall 34 having reached the final position does not cover the toner discharge port 319 from the inside. However, a smaller amount of toner remains in the storage space 31S of the container body 31 at the end of use of the toner container 30 than in the conventional toner container whose storage space volume does not change.

(8) In the above-described embodiment, the movable wall 34 moves from a position closer to the lid 37 to a position closer to the left wall 315. However, the present disclosure is not limited to this configuration. The initial position of the movable wall 34 may be made to be adjacent to the left wall 31, and the movable wall 34 may be made to move toward the toner discharge port 319 formed at a position closer to the lid 37.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A developer container, comprising:

a container body including an inner surface defining a cylindrical internal space extending in a first direction, and a first wall disposed at one end of the container body in the first direction and defining one end surface of the internal space, the container body being formed with a developer discharge port opening in a circumferential portion of the container body, the developer discharge port being disposed at a position higher than a lowest part of the container body by a predetermined amount and communicating with the internal space, the developer discharge port being configured to discharge developer therethrough;

a second wall disposed at the other end of the container body that is opposite to the first wall in the first direction and defining the other end surface of the internal space;

a shaft disposed in the internal space and above the discharge port, extending in the first direction, and supported on the first wall and the second wall;

a movable wall including an outer surface slidably in close contact with the inner surface of the container body, and a conveying surface defining a storage space for the developer in cooperation with the inner surface of the container body, the movable wall being movable along the shaft in the internal space while conveying the developer in the storage space to the developer discharge port; and a stirring member facing the developer discharge port in a direction intersecting the first direction and rotatable around an axis of the shaft in a specified rotational direction to stir the developer in the storage space, the specified rotational direction proceeding from the lowest part of the container body to the developer discharge port, the stirring member includes a disc facing the conveying surface and supported on the shaft, and a plurality of projecting pieces spaced away from one another in a circular direction and extending from the disc in the storage space, the projecting pieces being movable on a circular path according to rotation of the stirring member, the circular path lying inside the developer discharge port, the projecting pieces including a first plate shaped member that is oblique to a radial direction so that a radially inner end part thereof is positioned more downstream in the rotational direction than a radially outer end part thereof.

2. A developer container according to claim 1, wherein the projecting pieces include a second plate-shaped member extending in a direction intersecting a radial direction.

3. A developer container according to claim 1, wherein when the movable wall is at the developer discharge port, the conveying surface of the movable wall faces the stirring member.

4. A developer container according to claim 1, wherein the shaft includes a first engaging portion in the form of a helical ridge extending in the first direction and projecting from an outer surface of the shaft, the shaft being rotatably supported on the first wall and the second wall, the developer container further comprising:

a drive transmitter configured to transmit a torque generated by a specific driving source to the shaft; and a carrier bearing disposed in the movable wall and including a second engaging portion projecting from an inner surface of the carrier bearing and engageable with the first engaging portion, the carrier bearing allowing the shaft to pass therethrough, and the shaft being rotatable to bring the first engaging portion into engagement with the second engaging portion to thereby move the movable wall along the shaft.

5. An image forming apparatus, comprising:

a developer container according to claim 1;

an image carrier having a surface configured to allow an electrostatic latent image to be formed thereon, the image carrier being configured to carry a developed image;

a developing device configured to receive the developer supplied from the developer container and to supply the developer to the image carrier; and a transfer section configured to transfer the developed image from the image carrier onto a sheet.

6. A developer container, comprising:

a container body including an inner surface defining a cylindrical internal space extending in a first direction, and a first wall disposed at one end of the container body in the first direction and defining one end surface of the internal space, the container body being formed with a developer discharge port opening in a circumferential portion of the container body, the developer discharge port being disposed at a position higher than a lowest part of the container body by a predetermined amount and communicating with the internal space, the developer discharge port being configured to discharge developer therethrough;

a second wall disposed at the other end of the container body that is opposite to the first wall in the first direction and defining the other end surface of the internal space;

a shaft disposed in the internal space and above the discharge port, extending in the first direction, and supported on the first wall and the second wall;

a movable wall including an outer surface slidably in close contact with the inner surface of the container body, and a conveying surface defining a storage space for the developer in cooperation with the inner surface of the container body, the movable wall being movable along the shaft in the internal space while conveying the developer in the storage space to the developer discharge port; and a stirring member facing the developer discharge port in a direction intersecting the first direction and rotatable around an axis of the shaft in a specified rotational direction to stir the developer in the storage space, the specified rotational direction proceeding from the lowest part of the container body to the developer discharge port, the stirring member includes a disc facing the conveying surface and supported on the shaft, and a projecting portion extending from the disc in the storage space, the projecting portion being movable on a circular path according to rotation of the stirring member, the circular path lying inside the developer discharge port, wherein when the movable wall is at the developer discharge port, the conveying surface of the movable wall is in contact with a front end of the projecting portion.

7. A developer container according to claim 6, wherein the projecting portion includes a plurality of projecting pieces spaced away from one another in a circular direction.

8. A developer container according to claim 7, wherein the projecting pieces include a first plate-shaped member extending outward in a radial direction.

9. A developer container according to claim 7, wherein the first plate-shaped member is oblique to a radial direction, its radially inner end part being positioned more downstream in the rotational direction than its radially outer end part.

10. A developer container according to claim 7, wherein the projecting pieces include first plate-shaped members each extending radially outward, and second plate-shaped members each extending in the circular direction, the first plate-shaped members and the second plate-shaped members being disposed alternately in the circular direction.

11. A developer container according to claim 10, wherein one and another of the first plate-shaped members are disposed symmetrically to each another with respect to the axis of the shaft, and one and another of the second plate-shaped members are disposed symmetrically to each other with respect to the axis of the shaft.

12. A developer container, comprising:

a container body including an inner surface defining a cylindrical internal space extending in a first direction, and a first wall disposed at one end of the container body in the first direction and defining one end surface of the internal space, the container body being formed with a developer discharge port opening in a circumferential portion of the container body, the developer discharge port being disposed at a position higher than a lowest part of the container body by a predetermined amount and communicating with the internal space, the developer discharge port being configured to discharge developer therethrough;

a second wall disposed at the other end of the container body that is opposite to the first wall in the first direction and defining the other end surface of the internal space;

a shaft disposed in the internal space and above the discharge port, extending in the first direction, and supported on the first wall and the second wall;

a movable wall including an outer surface slidably in close contact with the inner surface of the container body, and a conveying surface defining a storage space for the developer in cooperation with the inner surface of the container body, the movable wall being movable along the shaft in the internal space while conveying the developer in the storage space to the developer discharge port; and a stirring member facing the developer discharge port in a direction intersecting the first direction and rotatable around an axis of the shaft in a specified rotational direction to stir the developer in the storage space, the specified rotational direction proceeding from the lowest part of the container body to the developer discharge port, wherein when the movable wall is at the developer discharge port, the outer surface of the movable wall covers at least a part of the developer discharge port from an inside of the container body.

13. A developer container, comprising:

a container body including an inner surface defining a cylindrical internal space extending in a first direction, and a first wall disposed at one end of the container body in the first direction and defining one end surface of the internal space, the container body being formed with a developer discharge port opening in a circumferential portion of the container body, the developer discharge port being disposed at a position higher than a lowest part of the container body by a predetermined amount and communicating with the internal space, the developer discharge port being configured to discharge developer therethrough;

a second wall disposed at the other end of the container body that is opposite to the first wall in the first direction and defining the other end surface of the internal space;

a shaft disposed in the internal space and above the discharge port, extending in the first direction, and supported on the first wall and the second wall;

a movable wall including an outer surface slidably in close contact with the inner surface of the container body, and a conveying surface defining a storage space for the developer in cooperation with the inner surface of the container body, the movable wall being movable along the shaft in the internal space while conveying the developer in the storage space to the developer discharge port; and a stirring member facing the developer discharge port in a direction intersecting the first direction and rotatable around an axis of the shaft in a specified rotational direction to stir the developer in the storage space, the specified rotational direction proceeding from the lowest part of the container body to the developer discharge port, the stirring member including a disc facing the conveying surface and supported on the shaft, and a projecting portion extending from the disc in an axial direction of the shaft in the storage space, the projecting portion being movable on a circular path according to rotation of the stirring member, the circular path lying inside the developer discharge port, the disc being disposed along the first wall and being formed continuously over an entire circumferential direction of the shaft.

14. A developer container according to claim 13, wherein the disc has a continuous surface aligned substantially normal to the shaft and the projection projects from the surface of the disc.

* * * * *